US010074528B2

(12) United States Patent
Makarov et al.

(10) Patent No.: US 10,074,528 B2
(45) Date of Patent: Sep. 11, 2018

(54) DATA ACQUISITION SYSTEM AND METHOD FOR MASS SPECTROMETRY

(75) Inventors: Alexander A. Makarov, Bremen (DE); Anastassios Giannakopulos, Bremen (DE); Matthias Biel, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 722 days.

(21) Appl. No.: 13/994,312

(22) PCT Filed: Dec. 15, 2011

(86) PCT No.: PCT/EP2011/073005

§ 371 (c)(1),
(2), (4) Date: Jun. 14, 2013

(87) PCT Pub. No.: WO2012/080443

PCT Pub. Date: Jun. 21, 2012

(65) Prior Publication Data

US 2013/0268212 A1 Oct. 10, 2013

(30) Foreign Application Priority Data

Dec. 17, 2010 (EP) ..... 10195585

(51) Int. Cl.
*H01J 49/02* (2006.01)
*H01J 49/00* (2006.01)

(52) U.S. Cl.
CPC ..... *H01J 49/025* (2013.01); *H01J 49/0036* (2013.01)

(58) Field of Classification Search
CPC ..... H01J 49/025; H01J 49/0036
See application file for complete search history.

(56) References Cited

U.S. PATENT DOCUMENTS 5,463,218 A * 10/1995 Holle ..... H01J 49/025 250/281
5,969,361 A * 10/1999 Blavette ..... H01J 43/045 250/397

(Continued)

FOREIGN PATENT DOCUMENTS

GB 2457112 A * 8/2009 ..... H01J 49/0036
JP H10-327175 A 12/1998

(Continued)

*Primary Examiner* — Alexander Satanovsky
*Assistant Examiner* — Lina Cordero
(74) *Attorney, Agent, or Firm* — David A. Schell; Charles B. Katz

(57) ABSTRACT

The invention provides a data acquisition system and method for detecting ions in a mass spectrometer, comprising: a detection system for detecting ions comprising two or more detectors for outputting two or more detection signals in separate channels in response to ions arriving at the detection system; and a data processing system for receiving and processing the detection signals in separate channels of the data processing system and for merging the processed detection signals to construct a mass spectrum; wherein the processing in separate channels comprises removing noise from the detection signals by applying a threshold to the detection signals. The detection signals are preferably produced in response to the same ions, the signals being shifted in time relative to each other. The invention is suitable for a TOF mass spectrometer.

19 Claims, 16 Drawing Sheets

(56) References Cited

U.S. PATENT DOCUMENTS

| | | | | |
|---|---|---|---|---|
| 6,756,587 | B1 | 6/2004 | Bateman et al. | |
| 7,220,970 | B2 * | 5/2007 | Rottmann | H01J 37/244 250/281 |
| 7,265,346 | B2 * | 9/2007 | Whitehouse | H01J 49/401 250/281 |
| 7,321,847 | B1 * | 1/2008 | Welkie | H01J 49/0036 702/189 |
| 7,501,621 | B2 * | 3/2009 | Willis | H01J 49/0036 250/281 |
| 2002/0175292 | A1 | 11/2002 | Whitehouse et al. | |
| 2003/0111597 | A1 | 6/2003 | Gonin et al. | |
| 2004/0149900 | A1 | 8/2004 | Makarov et al. | |
| 2005/0006577 | A1 * | 1/2005 | Fuhrer | H01J 49/0036 250/287 |
| 2005/0270191 | A1 * | 12/2005 | Hofstadler | G01N 33/6848 341/50 |
| 2006/0020400 | A1 * | 1/2006 | Okamura | H01J 49/025 702/22 |
| 2006/0080045 | A1 * | 4/2006 | Steiner | H01J 49/0027 702/23 |
| 2007/0158542 | A1 * | 7/2007 | Bauer | H01J 49/0036 250/282 |
| 2007/0231207 | A1 | 10/2007 | Mason | |
| 2008/0029697 | A1 | 2/2008 | Willis et al. | |
| 2009/0020697 | A1 * | 1/2009 | Hidalgo | H01J 49/0036 250/288 |
| 2009/0090861 | A1 | 4/2009 | Willis et al. | |
| 2010/0213361 | A1 * | 8/2010 | Green | H01J 49/0036 250/252.1 |
| 2012/0126110 | A1 * | 5/2012 | Green | G06K 9/0053 250/282 |

FOREIGN PATENT DOCUMENTS

| | | | |
|---|---|---|---|
| JP | WO9938190 | A2 | 7/1999 |
| JP | 2001-507513 | A | 6/2001 |
| JP | 2006-236795 | A | 9/2006 |
| WO | WO 2009/027252 | A2 | 3/2009 |

* cited by examiner

DATA ACQUISITION SYSTEM AND METHOD FOR MASS SPECTROMETRY

FIELD OF THE INVENTION

This invention relates to data acquisition systems and methods for detecting ions in a mass spectrometer and improvements in and relating thereto. The systems and methods are useful for a mass spectrometer, preferably a time-of-flight (TOF) mass spectrometer and thus the invention further relates to mass spectrometers and methods of mass spectrometry incorporating the data acquisition systems and data acquisition methods. The invention may be used for the production of high dynamic range and high resolution mass spectra and these spectra may be used for the identification and/or quantification of organic compounds, e.g. active pharmacological ingredients, metabolites, small peptides and/or proteins.

BACKGROUND OF THE INVENTION

Mass spectrometers are widely used to separate and analyse ions on the basis of their mass to charge ratio (m/z) and many different types of mass spectrometer are known. Whilst the present invention has been designed with Time-of-flight (TOF) mass spectrometry in mind and will be described for the purpose of illustration with TOF mass spectrometry, the invention is applicable to other types of mass spectrometry. Herein ions will be referred to as an example of charged particles without excluding other types of charged particles unless the context requires it.

Time-of-flight (TOF) mass spectrometers determine the mass to charge ratio (m/z) of ions on the basis of their flight time along a fixed flight path. The ions are emitted from a pulsed source in the form of a short packet of ions, and are directed along the fixed flight path through an evacuated region to an ion detector. A packet of ions comprises a group of ions, the group usually comprising a variety of mass to charge ratios, which is, at least initially, spatially confined.

The ions leaving the pulsed source with a constant kinetic energy reach the detector after a time which depends upon their mass, more massive ions being slower. A TOF mass spectrometer requires an ion detector with, amongst other properties, fast response time and high dynamic range, i.e. the ability to detect both small and large ion currents including quickly switching between the two, preferably without problems such as detector output saturation. Such a detector should also not be unduly complicated in order to reduce cost and problems with operation.

An existing approach to dynamic range uses the output of one detector which is amplified at two different levels, e.g. as described in GB 2457112 A. This amplification is carried out either within the electron multiplication device or in the preamplifier stage. These two amplified outputs from the same detector are then used to produce a high dynamic range spectrum. Other proposed solutions to the problem of detector dynamic range in TOF mass spectrometry have included the use of two collection electrodes of different surface areas for collecting the secondary electrons emitted from an electron multiplier (U.S. Pat. Nos. 4,691,160, 6,229,142, 6,756,587 and 6,646,252) and the use of electrical potentials or magnetic fields in the vicinity of anodes to alter so-called anode fractions (U.S. Pat. No. 6,646,252 and US 2004/0227070 A). Another solution has been to use two or more separate and completely independent detection systems for detection of secondary electrons produced from incident particles (U.S. Pat. No. 7,265,346). A further solution has been the use of an intermediate detector located in the TOF separation region which provides feedback to control gain of the final electron detector (U.S. Pat. No. 6,674,068). The problem with the latter detection is that it requires fast change of gain on the detector and it is also difficult to keep track of the gain in order to maintain linearity. A still further detection arrangement proposed in US2004/0149900A utilises a beam splitter to divide a beam of ions into two unequal portions which are detected by separate detectors. In all, these detection solutions can be complicated and costly to implement and/or their sensitivity and/or their dynamic range can be lower than desired.

Another problem with TOF mass spectrometers is that they also produce data at a very high rate since the detector output comprises a large number of ion detection signals in sequence within a very short interval of time, e.g. an entire TOF mass spectrum may be detected within a few milliseconds with a data sampling rate of, for example, 1 GHz or higher. Furthermore, many spectra, for example up to one million spectra or more, may be required for a given sample to be analyzed. Improvements in the acquisition and processing of data from a TOF mass spectrometer are therefore also desirable, e.g. methods to reduce the amount of data for processing as well as the duration and efficiency of data processing.

WO 2008/08867 describes the use of microprocessors and field programmable gate arrays (FPGAs) for the application of mathematical transformations to the output of ion detectors. For high speed applications, the spectra are thus at least pre-processed on the fly. Using mathematical transformations producing mass-intensity pairs in the FPGA which are then transferred to a computer is described in U.S. Pat. No. 6,870,156. Such methods use one detector which is amplified at two different levels as described above to provide two different gain signals to which the mathematical transformations are applied. A method for reducing the data set is described in U.S. Pat. No. 5,995,989, which comprises use of a background noise threshold which is continually determined and used to filter the data and decide which data to keep for subsequent processing. The application of the threshold in that method therefore involves continual calculation.

A further method for the measurement of ions by coupling different measurement methods is disclosed in U.S. Pat. No. 7,220,970, in which a collector and an SEM are used, the ions being selectively delivered to the collector or the SEM. In U.S. Pat. No. 7,238,936 is described a means to adjust detector gain in non-TOF spectrometers where there is sufficient time for an intermediate stage of detection to disable a subsequent stage of detection.

Accordingly, there remains a need to improve the detection of ions in mass spectrometry and in particular data acquisition systems and methods. In view of the above background, the present invention has been made.

SUMMARY OF THE INVENTION

According to an aspect of the present invention there is provided a data acquisition system for detecting ions in a mass spectrometer, the system comprising:

a detection system for detecting ions comprising two or more detectors for outputting two or more detection signals in separate channels in response to ions arriving at the detection system; and a data processing system for receiving and processing the detection signals in separate channels of the data processing system and for merging the processed detection signals to construct a mass spectrum;

wherein the processing in separate channels comprises removing noise from the detection signals by applying a threshold to the detection signals.

According to another aspect of the present invention there is provided a data acquisition method for detecting ions in a mass spectrometer, the system comprising:

detecting ions using a detection system comprising two or more detectors and outputting two or more detection signals from the two or more detectors in separate channels in response to ions arriving at the detection system;

receiving and processing the detection signals in separate channels of a data processing system, wherein the processing in separate channels comprises removing noise from the detection signals by applying a threshold to the detection signals; and merging the processed detection signals in the data processing system to construct a mass spectrum.

The data acquisition system and method of the present invention are especially useful for producing a high dynamic range mass spectrum in TOF mass spectrometry. The two or more detection signals generated by the detection system preferably have different gain so that the signals may be merged in the data processing system, after processing in separate channels, to form a high dynamic range spectrum. A dynamic range of $10^4$-$10^5$ has so far been found to be achievable for example. Spectra acquired using the system and method of the present invention, especially in TOF mass spectrometry, may be used for the identification and/or quantification of organic compounds, e.g. active pharmacological ingredients, metabolites, small peptides and/or proteins, and/or identification of genotypes or phenotypes of species etc.

By performing processing on each of the detection signals in separate processing channels prior to merging the processed signals to form the mass spectrum, especially applying the noise threshold, improved flexibility is provided in constructing mass spectra from the processed signals since each individual detection signal is independently subjected to each step of the data processing and the processing system thereby has available for construction of the mass spectrum a detection signal from each output of the detection system. The at least two signals originate from different, i.e. separate, detectors which have, e.g., a different noise level and a different base line and so a specific threshold function is preferably applied for each detection channel. Furthermore, the processed detection signals kept separate in this way may be stored separately, e.g. on a data system, for further use, e.g. in further constructions of mass spectra. The invention thus enables improved and more efficient use of data from the detection system. By the use of parallel processing of the detection signals in the separate channels, the improvements provided by the invention are not made at any significant expense of processing speed.

The mass spectrometer may be any suitable type of mass spectrometer but is preferably a TOF mass spectrometer. The term TOF mass spectrometer herein means a mass spectrometer which comprises a TOF mass analyser, either as the sole mass analyser or in combination with one or more further mass analysers, i.e. as a sole TOF or hybrid TOF mass spectrometer.

The mass spectrometer comprises an ion source for producing ions. Any known and suitable ion source in the art of mass spectrometry may be used. Examples of suitable ion sources include, without limitation, ion sources which produce ions using electrospray ionisation (ESI), laser desorption, matrix assisted laser desorption ionisation (MALDI), or atmospheric pressure ionisation (API). In keeping with the preferred application of the present invention in TOF mass spectrometry, the ion source is preferably an ion source, e.g. one of the aforementioned types, having a pulsed injector, suitable for a TOF mass spectrometer, i.e. a pulsed ion source which produces a packet of ions.

The ions produced by the ion source, e.g. the packet of ions produced in TOF mass spectrometry, are transferred to a mass analyser, which separates the ions according to mass-to-charge ratio (m/z). The mass spectrometer thus also comprises a mass analyser for receiving ions from the ion source. Any known and suitable mass analyser in the art of mass spectrometry may be used. Examples of suitable mass analysers include, without limitation, TOF, quadrupole or multipole filter, electrostatic trap (EST), electric sector, magnetic sector and FT-ICR mass analysers. Examples of ESTs include, without limitation, 3D ion traps, linear ion traps and orbiting ion traps such as the Orbitrap™ mass analyser. In keeping with the preferred application of the present invention in TOF mass spectrometry, the mass analyser preferably comprises a TOF mass analyser. Two or more mass analysers may be used for tandem ($MS^2$) and higher stage ($MS^n$) mass spectrometry and the mass spectrometer may be a hybrid mass spectrometer which comprises two or more different types of mass analysers, e.g. a quadruple-TOF mass spectrometer. It will be appreciated therefore that the invention is applicable to known configurations of mass spectrometers including tandem mass spectrometers (MS/MS) and mass spectrometers having multiple stages of mass processing ($MS^n$).

Additional components such as collision cells may be employed to provide the capability to fragment ions prior to mass analysis by a mass analyser.

The ions separated according to mass-to-charge ratio (m/z) by the mass analyser arrive for detection at the detection system. Further details of the detection system are described below.

It will be appreciated that the various stages of the mass spectrometer of ion source, mass analyser(s), and detection system, as well as optional stages such as, e.g., collision cells, may be connected together by ion optical components, as known in the art, e.g. using one or more of ion guides, lenses, deflectors, apertures etc.

The mass spectrometer may be coupled to other analytical devices as known in the art, e.g. it be coupled to a chromatographic system (e.g. LC-MS or GC-MS) or an ion mobility spectrometer (i.e. IMS-MS) and so on.

The system and method of the invention are useful when a high dynamic range of ion detection is required and also where such detection is required at high speed, e.g. as in TOF mass spectrometers. The invention is particularly suitable for detection of ions in TOF mass spectrometers, preferably multi-reflection TOF mass spectrometers, and more preferably multi-reflection TOF mass spectrometers having a long flight path. The invention may be used with a TOF mass spectrometer wherein the peak widths (full width at half maximum height or FWHM) of peaks to be detected are up to about 50 ns wide, although in some instances the peak widths may be wider still. For example, the peak widths of peaks may be up to about 40 ns, up to about 30 ns and up to about 20 ns, typically in the range 0.5 to 15 ns. Preferably the peak widths of peaks to be detected are 0.5 ns or wider, e.g. 1 ns or wider, e.g. 2 ns or wider, e.g. 3 ns or wider, e.g. 4 ns or wider, e.g. 5 ns or wider. Preferably the peak widths of peaks to be detected are typically 12 ns or narrower, e.g. 11 ns or narrower, e.g. 10 ns or narrower. The peak widths may be in the following ranges, e.g. 1 to 12 ns, e.g. 1 to 10 ns, e.g. 2 to 10 ns, e.g. 3 to 10 ns, e.g. 4 to 10 ns, e.g. 5 to 10 ns.

The detection system is preferably a detection system for detecting ions in a TOF mass spectrometer. Fast detectors are therefore desirable and are known in the art. The detection system comprises at least first and second detectors for respectively generating first and second detection signals in separate channels in response to ions arriving at the detection system. The system of the present invention thus comprises independent first and second detectors in contrast to the prior art systems described in GB 2457112, WO 2008/08867, U.S. Pat. No. 7,501,621 and US 2009/090861 A which utilise a single detector providing a single detection signal which is merely amplified subsequently at two different gains.

The two or more detectors preferably produce the detection signals from the same ions, the signals being shifted in time relatively to each other. Thus, the same ions, or secondary particles such as electrons produced therefrom, that first arrive at the first detector to produce a signal from the first detector after a time delay arrive at the second detector to produce a signal from the second detector, the signal from the second detector thereby being delayed in time relative to the signal from the first detector. This enables an efficient use of the ions by using the same ions for detection by both first and second detectors. The second detector is thus preferably located downstream of the first detector, more preferably it is located behind the first detector.

The first and second detectors may comprise the same type of detector or, preferably, different types of detector. The first and second detectors are preferably a low gain detector and a high gain detector respectively. The first and second detectors are preferably each independently either a charged particle detector (e.g. a detector of the arriving ions or secondary electrons generated from arriving ions) or a photon detector (e.g. a detector of photons generated directly or indirectly from the arriving ions). For example, each of the first and second detectors may comprise a charged particle detector or each of the first and second detectors may comprise a photon detector or one of the first and second detectors may comprise a charged particle detector and the other of the first and second detectors may comprise a photon detector. Preferably, the first detector, which may be the low gain detector, comprises a charged particle detector. Preferably, the second detector, which may be the high gain detector, comprises a photon detector. The apparatus is thereby able to detect high rates of incoming particles before saturation of the output occurs, e.g. by the use of a charged particle detector of typically lower gain than the photon detector albeit with more noise. A large dynamic range is therefore achievable. Suitable types of charged particle detector include electron detectors, e.g. the following: a secondary electron multiplier (SEM), wherein the SEM may be a discrete dynode SEM or a continuous dynode SEM, with a detecting anode. The continuous dynode SEM may comprise a channel electron multiplier (CEM) or more preferably a micro-channel plate (MCP). Suitable types of photon detector include the following, for example: a photodiode or photodiode array (preferably an avalanche photodiode (APD) or avalanche photodiode array), a photomultiplier tube (PMT), charge coupled device, or a phototransistor. Solid state photon detectors are preferred and more preferred photon detectors are a photodiode (preferably avalanche photodiode (APD)), photodiode array (preferably APD array) or a PMT. The detection system may be for detecting either positively charged ions or negatively charged ions.

In one preferred arrangement of detection system, the detection system comprises an SEM which generates secondary electrons in response to receiving arriving ions and a charged particle detector is used which comprises a detection anode or electrode which is transparent to the secondary electrons produced by the SEM. The transparent electrode picks-up the passage of the electrons through it, e.g. the electrons are detected using a charge or current meter coupled to the transparent electrode. The transparent electrode, which may comprise a thin conductive (e.g. metal) layer, thus forms a first, low gain detector of the detection system. The electrons which pass through the transparent electrode then produce a signal from the second detector. In particular, the electrons which pass through the transparent electrode strike a scintillator and photons generated by the scintillator are detected by a photon detector. The photon detector thus forms a second, high gain detector of the detection system. Such detectors are described in patent application nos. GB 0918629.7 and GB 0918630.5 the contents of which are hereby incorporated by reference in their entirety. Such a detection system is highly efficient since secondary electrons which are detected by the charge detector are also used to generate photons which are detected by the photon detector. The use of photons and photon detector also enables a decoupling from the high voltages used for the secondary electron generation, e.g. to make that part of the detection system independent of the acceleration voltage (and polarity).

Although first and second detectors are referred to herein, this does not exclude the use of one or more further detectors and output of one or more further detection signals in separate channels, e.g. a third detector and detection signal and so on, which may be useful in some cases. In such cases, it is preferable that such one or more further detectors are respectively for generating one or more further detection signals and such signals are received and processed in one or more further respective channels of the data processing system, i.e. each detector generates a respective detection signal in its own channel which is received and processed in its own respective processing channel and each respective processed detection signal is used to construct the mass spectrum. Accordingly, references herein to first and second detection signals, first and second detectors, first and second channels and the like include the cases of having third (and further) detection signals, third (and further) detectors, third (and further) channels etc. preferably, however, the detection system only comprises two detectors.

The detection system used by the present invention therefore preferably has a high dynamic range, which moreover may be provided by a simple, robust and low cost arrangement of components. The detection system is preferably responsive to low rates of incoming ions down to single particle counting, i.e. has high sensitivity, e.g. provided by the use of a high gain detector such as a photon detector, which has the advantage of high gain and low noise due to photon detection at ground potential. The detection system is additionally able to detect high rates of incoming particles before saturation of the output occurs, e.g. by the use of a low gain detector such as a charged particle detector of typically lower gain than the photon detector albeit with more noise. A dynamic range of $10^4$-$10^5$ may be achievable for example by merging the data from the first and second detectors, i.e. after processing the first and second detection signals, to yield a high dynamic range spectrum. The invention may therefore avoid the need to acquire multiple spectra at different gains in order to detect both very small and very large peaks.

A further advantage of such an arrangement is that if one detector should fail to operate during an experimental run, at least some data may still be acquired from the remaining working detector or detectors.

The data processing system is designed to perform one or more functions which are now described in more detail.

Preferably, the data processing comprises pre-amplifying the detection signals in the separate channels. The signals may be independently pre-amplified in this way, i.e. with the same or different gain applied, preferably different gain. This enables a further differentiation of the gain between the detection signals in addition to any differentiation of the gain which preferably arises from the use of different types of detector as first and second detectors of the detection system. Applying a gain difference between the channels using the pre-amplifier, in addition to any difference in gain inherent between the detectors, also enables the full range of an ADC to be used. Therefore, the data processing system preferably comprises a pre-amplifier, preferably having two or more channels for independently pre-amplifying each detection signal. The pre-amplified detection signals are outputted from the pre-amplifier in the separate channels to a further component of the data processing system, preferably a digitiser. Preferably, the detection signals are amplified before any other processing.

Preferably, the data processing comprises digitising the detection signals in the separate channels of the data processing system. The signals may be independently digitised in this way. The system may comprise two (or more) separate (independent) digitisers, i.e. one for each channel, or a dual channel digitiser (or multi-channel digitiser) may be used and indeed may be cost efficient. Suitable dual channel digitizers with the required data rates and accuracies for the present application are used, e.g., for I/Q-detection in telecommunications applications. The detection signals are thus each preferably digitised in an analog-to-digital converter (ADC) having two or more channels for independently digitising the detection signals. Therefore, the data processing system preferably comprises a digitiser (ADC), preferably having two or more channels for independently digitising each detection signal. The detection signals, preferably after pre-amplification in separate channels as described above, are preferably respectively input to separate channels of the ADC in order to digitise them before further processing, including before the step of removing noise by applying the threshold. The digitised detection signals are outputted from the ADC in the separate channels to a further component of the data processing system.

The data processing system is a system with two (or more) processing channels for separating processing each of the detection signals, especially for parallel processing in the two (or more) processing channels. Preferably most of the processing of the detection signals is performed in separate channels of the data processing system prior to merging the detection signals to construct the mass spectrum. Thus, the processing of the detection signals is performed in separate, i.e. independent, processing channels of the data processing system, preferably in parallel (i.e. simultaneously). The detection signals are thus kept apart in the data processing system until the mass spectrum is constructed by merging the detection signals. The term processed detection signals herein refers to the detection signals after they have been processed by the data processing system. The processed detection signals are then merged by the data processing system to construct the mass spectrum.

In addition to the optional steps of pre-amplifying and digitising the detection signals described above (which are preferably performed before other data processing), the data processing preferably includes one or more of the following steps, with step iii) being essential:

i.) Decimating the detection signals;

ii.) Calculating the threshold for removing the noise;

iii.) Removing noise from the detection signals by applying a threshold;

iv.) Packing the detection signals after removing noise;

v.) Characterising peaks in the signals.

Whilst the order of processing steps may be varied, the order of steps above represents the preferred order of the steps. Further optional data processing steps, such as processing steps known in the art, may be performed by the data processing system in the separate channels prior to merging the detection signals. Following the selected processing steps above is the step of merging the processed detection signals to construct the mass spectrum.

It will be realised that the processing performed by the data processing system performs the function of reducing the data of the detection signals prior to constructing the mass spectrum in order to simplify and speed up the construction of the mass spectrum. The processing steps will be described now in more detail.

The processing preferably comprises decimating the detection signals in separate channels of the data processing system to reduce the sampling rate of each of the detection signals. The sampling rate of each of the detection signals may be reduced, e.g., by a factor of 2 or 4, or another value. The resultant sampling rate of the detections signals after decimation may typically be at least 250 MHz, preferably in the range from 250 MHz to 1 GHz, more preferably 250 MHz to 500 MHz Preferably, the decimation results in a number of data points per peak which is on the order of e.g. 3, 5, 7, 9 or 11 points over an average peak width. The decimation is performed after the digitising step The decimating, like the other processing steps, is preferably performed in parallel in each of the respective processing channels on the detection signals. The data processing system preferably comprises a decimator or decimation module to perform the decimation. The decimator or decimation module is preferably implemented on a dedicated processor such as an FPGA, GPU or Cell, or on other dedicated decimation hardware. The decimation module preferably processes the detection signals after the optional pre-amplifier and ADC but before a threshold module removes the noise. Suitable decimation methods include: adding a number of consecutive points (i.e. input values to the decimator) to form a resulting point (i.e. output value of the decimator), which is a form of averaging; only keeping every $n^{th}$ input value. Typically in the decimation a digital filter (typically a band-pass filter) is applied to the signals before reduction of the number of points. If "spikes" in the signals are a present problem then this may be a reliable solution (however, other solutions, such as median filters, exist).

The processing comprises removing noise from the detection signals by applying a threshold to them. The data processing system preferably comprises a noise threshold or noise removal module for applying the threshold to remove noise. The threshold or noise removal module may be implemented on a dedicated processor such as, e.g. an FPGA, GPU or Cell, more preferably the same dedicated processor which was used to perform the decimation where decimation is used. The dedicated processor is preferably for applying the threshold to remove noise on-the-fly.

The step of removal of noise results in leaving only peaks in the detection signals (i.e. peaks which stick out from the background). The detection signals each comprise a sequence of data points in time (i.e. a transient), each point having an intensity value, the points making up a data set. The threshold functions to remove noise from the detection signals, i.e. it removes points which have intensity values less than a threshold. The removed points are effectively replaced by a zero in the data. Accordingly, it only transfers points of the detection signals for merging of the detections signals which are not less than the threshold. In that way the bandwidth required for transfer and storage of the data is reduced.

The threshold applied by the data processing system rejects points of the detection signals having intensity values lower than a threshold so that only points of the detection signals having intensity values equal to or exceeding one or more threshold values are used to construct the mass spectrum. The threshold is a measure of the noise of the detection signals so that applying the threshold acts as a noise filter. The threshold may comprise one or more threshold values. A single threshold value may be used for all points of the detection signals but preferably, especially for TOF applications, a plurality of threshold values are used, e.g. wherein each point or group of points of the detection signal is filtered using its own associated threshold value, i.e. has its own associated threshold applied to it. Thus, since the points in the detection signals are points in time, preferably, especially for TOF applications, the threshold is a dynamic threshold which varies with the time in the detection signal, e.g. which is the time of flight in TOF applications.

A threshold is applied to remove noise in each of the separate processing channels, i.e. so that it is applied independently to the detection signals, preferably in parallel. The same or separate thresholds may be applied to each of the detection signals but preferably a separate threshold is applied to each of the detection signals. Applying thresholds independently to the first and second detection signals enables more accurate thresholds to be used and hence better use of the data from each detection signal, e.g. there may be less chance of losing useful data which might occur when applying the same threshold level to both signals. Since the at least two detection signals originate from different detectors, which may have a different noise level and a different base line, a specific threshold function is preferably needed for each channel. The threshold application may also comprise correlated peak picking (i.e. wherein thresholds are applied independently to the signals in each channel, but when a peak is found in a signal in one channel, which peak is constituted by a group of data points, the corresponding group of data points is kept in both channels).

Where separate thresholds are calculated for the detection signals, the thresholds may be calculated either in parallel or sequentially, preferably in parallel. The threshold may be calculated on-the-fly from the detection signals having the threshold applied to them or may be calculated from one or more previous detection signals or from one or more mass spectra previously constructed. Where the threshold is calculated on-the-fly from the detection signal having the threshold applied to it, the calculation of the threshold is preferably performed by a fast processing device of the data processing system, e.g. FGPA, GPU or Cell, as described in more detail below. In other words, the threshold module is preferably implemented on a fast processing device as aforementioned. Where the threshold is calculated from one or more previous detection signals or from one or more mass spectra previously constructed, the calculation of the threshold is preferably performed in the instrument computer of the data processing system, as described in more detail below.

The threshold is preferably stored in a look-up-table (LUT), e.g. having various time ranges, especially for TOF applications. The threshold is therefore simply applied by comparing the detection signal to the threshold stored in the LUT. Comparing the detection signal to a threshold stored in a LUT is a computationally simple procedure and has been found to be effective as a noise filter. A separate LUT is preferably calculated and used for each detection signal, i.e. a separate LUT is preferably calculated for each processing channel. The LUT preferably resides, at least whilst the threshold is being applied, on the fast processing device, especially if calculated on the fast processing device. The LUT may be calculated and/or stored on another processor, e.g. a CPU core, e.g. of the instrument computer, especially if calculated on the other processor, and uploaded to the fast processor for the fast processor to apply the threshold, wherein the LUT resides, at least whilst the threshold is being applied, on the fast processing device.

One LUT may be calculated for a given processing channel and used for processing a plurality of following detection signals in that channel, which is preferable from the point of view of processing efficiency since a new LUT is not calculated for each new detection signal. Alternatively, particularly if the noise level varies significantly from one detection signal (scan) to another, a new LUT may be calculated and used for each detection signal. In the latter case, it is especially preferable to calculate each new LUT on the fast processing device which will apply the threshold for noise removal. Such on-the-fly calculation of the LUT or threshold requires that data are cached during the determination of the threshold. Another method may comprise remembering the general shape of the LUT from a previous (original) scan and scaling the whole LUT by a factor determined on a lower number of points than used for construction of the original LUT. The latter may involve the caching of one or more full LUTs/scans until the LUT is updated. In certain embodiments the dynamics of the LUT may be limited so as to not exceed expected maximum scan to scan variations and to coordinate the relative scaling of the thresholds between the two (or more) channels.

The detections signals, i.e. the points thereof, which pass the threshold for noise removal are preferably packed by the data processing system, e.g. for more efficient further processing (e.g. characterising the peaks) and/or transferring to a different device of the data processing system (e.g. transferring to a general purpose computer, such as part of the instrument computer, from a fast dedicated processing device which performed the noise removal). The packing step is preferably performed on each of the detection signals, i.e. in each of the separate channels, and is typically for enabling faster further processing and/or transferring of the detection signals. Packing of the data preferably comprises packing the data into frames. In applying the threshold the noise points identified thereby are typically replaced with zeros. The zeros left in the data by applying the threshold are preferably omitted in the packed data, enabling the data to be compressed. The positions of the remaining data in the packed data are preferably indicated, e.g. by a time stamp or other positional value (e.g. the sequential number of the data in the signal). Preferably, the width of each frame is flexible such that each frame has a size in a range from a minimal size to a maximal size and such that each frame consists of the minimal size, unless a peak is present where the minimal size is reached in a frame which case the frame is extended above the minimal size until the peak is finished subject to the frame not extending above the maximal size so that if the peak is present where the maximal size is reached the points of the peak continue in the next frame. Further details and examples of the data packing are given herein below. Reducing the data in the ways described herein and packing the reduced data on the data processing system facilitates high speed transfer within the data processing system, e.g. transfer from a dedicated on-the-fly processor such as an FPGA, GPU or Cell to the instrument computer, and subsequently faster processing.

The invention preferably proceeds to detect and characterise peaks in the detection signals after the step of noise removal by applying the threshold. If the data has been packed after noise removal, the data is preferably unpacked before the peak detection and/or characterisation is carried out. The unpacking preferably does not comprise reintroducing zeros into the data but peak data are preferably extracted from the frames. The peak detection is performed in order to identify specific peaks in the data left after thresholding. The peak detection is performed before the characterisation of the detected peaks and the characterisation may comprise one or preferably both of the following steps:

a) Generating one or more quality factors for the peaks; and
b) Determining centroids of the peaks, e.g. using a centroiding algorithm.

The quality factor may be used to determine whether the determined centroid of the peak is or will be reliable and whether further action is necessary, e.g. applying a different (e.g. more sophisticated) peak detection and/or centroiding algorithm, or acquiring the peak again i.e. from a fresh detection signal. Preferably the quality factor of a peak comprises assessing the smoothness and/or shape of the peak and optionally comparing the smoothness and/or shape of the peak to an expected or model smoothness and/or shape. Further details of the detecting and characterising peaks are described below. Optionally, peaks which ultimately cannot be acquired with a sufficiently high quality factor (e.g. even after optional re-acquisition or advanced peak detection methods) may be discarded from the final merged spectrum (e.g. not used to form the final merged spectrum) or may be retained in the merged spectrum but optionally flagged as of low quality.

The invention preferably aligns the two or more detection signals prior to merging them. This alignment is to correct for time delays between the separate channels. One or more detection signals are moved on the time axis by a determined offset. The offset may have been determined in a calibration step.

A calibration step is preferably performed to convert the time coordinate of the peaks of the detection signals into m/z ratio. The calibration may be performed before or after merging the detection signals to construct the mass spectrum. In other words, for TOF applications, the invention comprises calibrating the detection signals and/or the mass spectrum to convert time-of-flight to m/z. Calibration methods are known in the art and may be used in the present invention. Internal calibration and/or external calibration may be used, as described in more detail below.

The processed detection signals are merged by the data processing device to construct a mass spectrum, preferably a mass spectrum of high dynamic range (HDR). Such a mass spectrum is herein referred to as a merged mass spectrum. The processed detections signals preferably comprise high gain signal and a low gain signal, e.g. because the detection signals are generated by at least first and second detectors of inherently different gain and/or because of different gain applied by a pre-amplifier. As described elsewhere herein, the high gain detection signal preferably originates from a detector which is a photon detector and the low gain signal preferably originates from a detector which is a charged particle detector. The use of high gain signal and a low gain signal, especially from the aforementioned detector types, enables the HDR spectrum to be obtained.

The step of merging the high gain detection signal and the low gain detection signal to form the (high dynamic range) mass spectrum preferably comprises using the high gain detection signal to construct the mass spectrum for data points in the mass spectrum where the high gain detection signal is not saturated and using the low gain detection signal to construct the mass spectrum for data points in the mass spectrum where the high gain detection signal is saturated. For data points in the mass spectrum where the low gain detection signal is used to form the mass spectrum, the low gain detection signal is preferably scaled by an amplification of the high gain detection signal relative to the low gain detection signal.

The data rate in the merging step may be reduced, e.g. by merging the detection signals using only the centroids of the detection signals. Thus, only centroid-intensity pairs of the detection signals may be merged.

The merging may comprise merging only those peaks having a sufficiently high quality factor. Peaks with too low quality factor may be subject to advanced peak detection and/or re-acquiring of the peak to improve the quality factor before optionally merging them into the constructed mass spectrum after the sufficiently high quality factor has been achieved. In practice, only one detection signal has to contain a peak having a sufficiently high quality factor. Thus preferably, for a given peak, only the signal with the highest quality factor for that peak is used for the merged spectrum provided that the highest quality factor is itself sufficiently high.

For each channel, two or more, preferably a large number of, detection signals processed in that channel may be summed together before the detection signals from the separate channels are merged together to form the final mass spectrum. The summing of detection signals may be performed at any suitable point in the data processing. For example, the detection signals may be summed after decimation, e.g. on the fast processor described herein, prior to the noise removal, i.e. so that one noise removal step is performed on a sum of a plurality of detection signals. In another example, a plurality of the processed detection signals may be summed, i.e. after the processing steps have been performed on each signal, but prior to the merging of the signals from each channel to form the merged mass spectrum.

Alternatively, or additionally, two or more, preferably a large number of, merged mass spectra may be summed to form the final mass spectrum.

References herein to a mass spectrum include within their scope references to any other spectrum with a domain other than m/z but which is related to m/z, such as, e.g., time domain in the case of a TOF mass spectrometer, frequency domain etc.

In summary, the processing by the data processing system may comprise, preferably, the following processing steps:

digitising the detection signals in separate channels;

applying a look-up-table (LUT) to the detection signal in each separate channel of the data processing system in which a detection signal is to be processed, wherein the LUT defines a threshold representing the noise level;

removing noise from the detection signals in separate channels by applying the thresholds in the LUTs, e.g. using a fast, dedicated processor, e.g. FPGA, GPU or Cell, wherein only points of the detection signals which are not less than the thresholds pass the thresholds and are transferred;

packing the points of the detection signals which pass the thresholds, e.g. using the fast processor, and transferring the packed points to the instrument computer;

unpacking the points of the detection signals on the instrument computer and detecting peaks in the detection signals;

finding centroids of the detected peaks using the instrument computer;

determining one or more quality factors of the detected peaks, optionally using the quality factors to determine which further data processing steps or further data acquisition steps are taken (i.e. using the quality factors for data dependent decisions); and aligning the detection signals, e.g. using values determined during a calibration. Following these processing steps is the step of merging the processed detection signals to construct the mass spectrum.

The data processing system comprises at least one data processing device, which may comprise any suitable data processing device or devices. The data processing system preferably comprises at least one dedicated processing device, especially for fast processing of the detection signals from the detection system on-the-fly. A dedicated processing device is typically only required and/or used for the time critical steps, which are the steps up to and optionally including the data packing step. Preferably, the at least one dedicated processor is designed to do at least decimation and noise filtering using the threshold. Subsequent steps may be performed effectively at any time, including off-line (unless information is required for data dependent acquisition decisions in the system). A dedicated processing device of the data processing system is especially a fast processing device having two or more channels for performing parallel computations therein. The main characteristic of the dedicated processing device is that it has to be able to perform the required computation steps at the required (decimated) data rate. Preferred examples of such fast dedicated processing devices include the following: a digital receive signal processor (DRSP), an application-specific integrated circuit (ASIC), a field programmable gate array (FPGA), a digital signal processor (DSP), a graphics processing unit (GPU), a cell broadband engine processor (Cell) and the like. Preferably, the data processing system comprises a dedicated processing device selected from the group consisting of an FPGA, GPU and a Cell. The data processing system may comprise two or more dedicated data processing devices, e.g. selected from the group of an FPGA, GPU and a Cell, and the two or more dedicated data processing devices may be the same (e.g. two FPGAs) or different (e.g. an FPGA and a GPU). However, it is less preferred to use two or more such dedicated processing devices in the data processing system since the bus connection between the devices might become a bottleneck for the data and a single such device is typically capable of performing the required data processing. Accordingly, the data processing system preferably has one dedicated data processing device such as a device selected from the group of an FPGA, GPU and a Cell. The at least one dedicated processing device is preferably used for the on-the-fly processing or calculations.

The at least one dedicated processing device may perform partial processing of the detection signals (i.e. some but not all of the processing steps) or, in some cases, all of the processing of the detection signals. The at least one dedicated processing device is preferably used for at least the step of removing noise from the detection signals by applying the threshold. As mentioned above, the dedicated processing device is typically only required and/or used for the time critical steps, which are the steps up to and optionally including the data packing step, which includes the step of removing noise from the detection signals by applying the threshold. The at least one dedicated processing device is thus further preferably used for at least the following data processing steps described herein:

Decimating the detection signals;

Removing noise from the detection signals by applying the threshold;

Packing the detection signals after removing noise.

The at least one dedicated processing device may also be used for other data processing steps including any one or more of the following steps:

Calculating the threshold for removing the noise;

Characterising peaks in the detection signals (e.g. after noise removal);

Merging the detection signals to construct a mass spectrum.

The step of calculating the threshold for noise removal is preferably performed on the dedicated processing device where the threshold is needed to be calculated on-the-fly, e.g. where a fresh LUT defining the threshold is required for each detection signal, for performance reasons. In other cases, the threshold/LUT is preferably calculated on a different, preferably multi-purpose, computer, e.g. a multi-core processor, CPU or embedded PC, which may be a processor of the instrument computer, and uploaded to the dedicated processor such as the FPGA, GPU or Cell for the threshold to be applied to the detection signals.

The steps of characterising peaks in the detection signals and/or merging the detection signals to construct a mass spectrum may also be performed on a dedicated processing device but preferably are performed on a general purpose computer, e.g. a multi-core processor, CPU or embedded PC, which may be the instrument computer or a part thereof, after the detection signals are partially processed by and transferred from the dedicated processor.

The data processing system preferably comprises a computer, which is commonly referred to as the instrument computer. The instrument computer typically comprises a general purpose computer, e.g. multi-core processor, CPU or embedded PC. The instrument computer may optionally comprise a dedicate processor, such as a GPU or Cell for example, for accelerated data processing. The instrument computer may perform some of the data processing steps after noise removal by the threshold, such as peak characterisation and constructing the mass spectrum by merging the processed detection signals.

The instrument computer is capable of controlling one or more operating parameters of the instrument, i.e. the mass spectrometer, e.g. ion isolation window width, ion injection time, collision energy where a collision cell is used, as well as functions such as self monitoring, e.g. detector recalibration. The instrument computer preferably makes data dependent decisions to modify operating parameters of the mass spectrometer for subsequent data acquisitions, i.e. acquisitions of detection signals, based on evaluation of a data acquisition, e.g. based on evaluating peak quality in a mass spectrum. The calculated peak quality factors may be used for such evaluations. For example, a badly resolved peak as evaluated by the data processing system may cause the instrument computer to modify the operating parameters of the mass spectrometer so as to acquire a better quality peak or spectrum (e.g. at higher resolution) in a subsequent acquisition. As another example, the instrument computer may evaluate the profile of a chromatographic peak in an LC-MS experiment in order to determine when to perform an MS/MS acquisition. Other examples of the types of data dependent decisions that could be made by the instrument computer are disclosed in WO 2009/138207 and WO2008/025014. A typical data dependent decision is to decide on the basis of the detected masses whether to initiate isolation and/or fragmentation of specific masses in subsequent experiments.

The instrument computer may be used for control of one or more operating parameters of the detection system, e.g. as a consequence of one or more data dependent decisions, e.g. one or more data dependent decisions based on evaluation of peaks in the processed detection signals and/or mass spectrum. For example, the instrument computer may control the gain of one or more of the detectors of the detection system or the detection signal generated therefrom. For example, operating parameters of the detector may be changed or the amount of pre-amplification of the detections signal may be changed. For example, the gain of a detector or its signal may be reduced where a saturation condition is detected in a detection signal generated by the detector. The instrument computer may be used, for example, to implement gain control by a feedback process. In one such embodiment, detection signals acquired by the data processing system from one or more of the detectors from one experimental run may be used for gain control of one or more of the detectors in a subsequent experimental run.

In particular, the gain of a detection signal or detector may be controlled in the following ways:

By using a previous detection signal or mass spectrum to determine when an intense (or weak) peak will arrive, e.g. a peak above (or below) a pre-determined threshold. Then one or more of the following methods can be used:

a) Adjusting the gain down (or up) of the detector while the intense (or weak) peak is present (i.e. being detected). Reducing the gain for intense peaks may also prolong the life of the detector, especially for photon detectors;

b) Adjusting the number of arriving ions at the detection system or a number of secondary electrons generated in an SEM of the detection system from the arriving ions while the intense (or weak) peak is present (i.e. being detected), preferably by one or more of the following methods:

i) Adjusting the focusing of the arriving ions or generated secondary electrons;

ii) Adjusting the numbers of arriving ions from the ion source;

iii) Adjusting the gain on the SEM.

By monitoring chromatographic peak profiles in the case of an LC-MS experiment to determine the required amplifier gain for a certain mass and adjusting the gain on one or more detector(s) based on the determined required amplifier gain.

The processed detection signals and/or mass spectrum constructed by the data processing system and/or data derived therefrom (such as e.g. quantitation information, identified (and optionally quantified) molecules (e.g. metabolites or peptides/proteins), etc.) may be transferred to a data system, i.e. a mass data storage system or memory, e.g. magnetic storage such as hard disk drives, tape and the like, or optical discs, which it will be appreciated can store a large amount of data. The detection signals and/or mass spectra and/or derived data held by the data system may be accessed by other programs, e.g. to allow for spectra output such as display, spectra manipulation and/or further processing of the spectra by computer programs.

The system preferably further comprises an output, e.g. a video display unit (VDU) and/or printer, for outputting the mass spectrum and/or derived data. The method preferably further comprises a step of outputting the mass spectrum, e.g. using a VDU and/or printer.

It will be appreciated that the system may be required on some occasions to be operated without performing a noise removal step and optionally without one or more other processing steps following digitisation. In such a case, the threshold for noise removal, e.g. the threshold values held in the LUTs, may be set, for example to zero or another value, e.g. a slightly negative value for noise at zero offset, so as to pass all data points of the detection signals, e.g. for processing the full detection signals on the instrument computer. Such an operation of the system is known as full profile operation and is for acquiring a full profile spectrum, wherein every digitisation point of the detection signal from the detections system is transferred to the data processing device which will perform the merging of the detection signals, e.g. the instrument computer. More commonly, the system will be used in reduced profile operation to acquire a reduced profile spectrum, where the noise removal using the threshold has been performed and reduced profile data are thereby transferred to the data processing device which will perform the merging of the detection signals.

DETAILED DESCRIPTION

In order to more fully understand the invention, various non-limiting examples of the invention will now be described with reference to the accompanying Figures in which.

Figure 1:
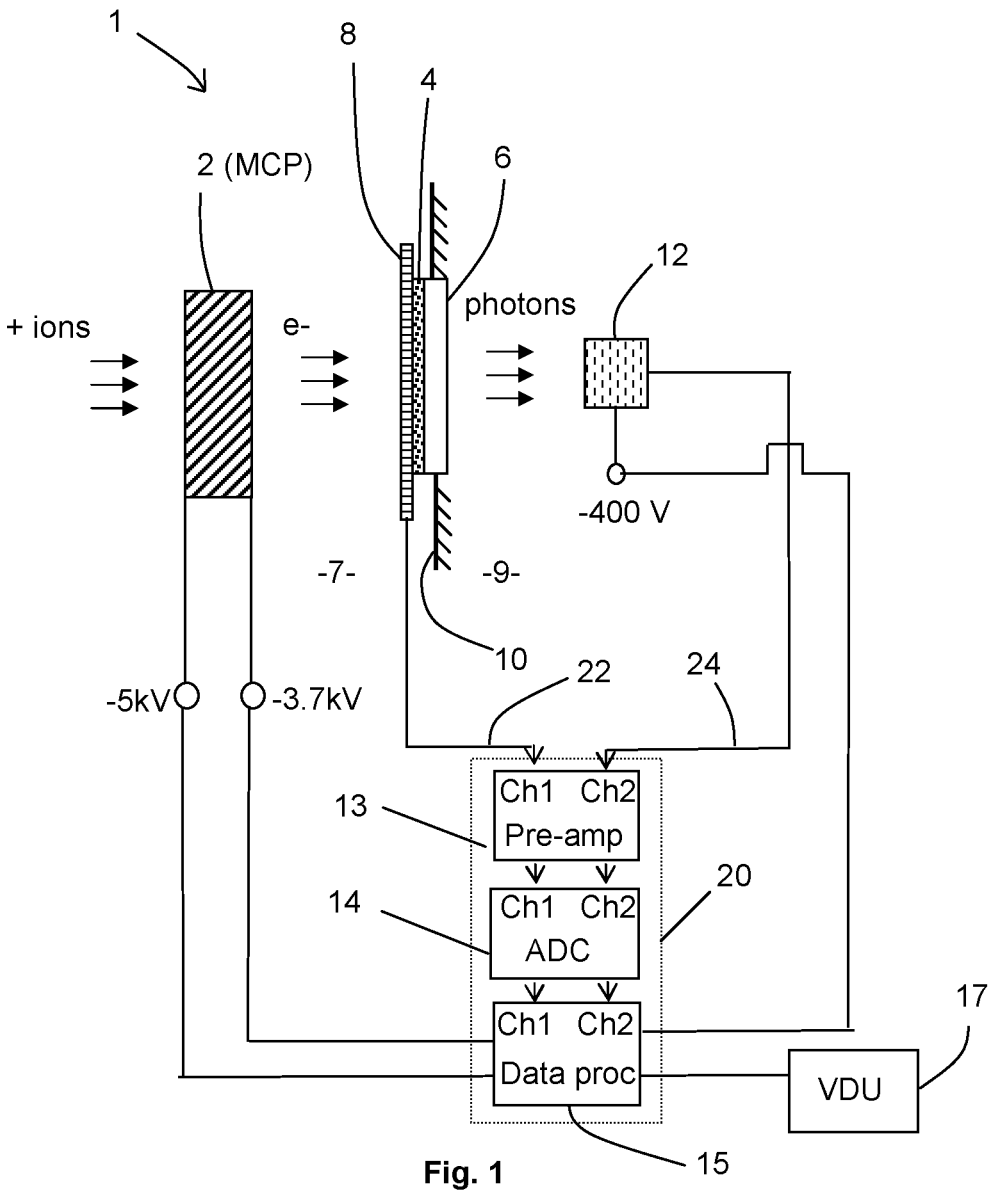
FIG. 1 shows schematically an embodiment of a detection system forming a part of a data acquisition system according to the present invention.

Referring to FIG. 1 there is shown schematically a preferred embodiment of a detection system for use with the present invention. The detection system 1 comprises a micro-channel plate (MCP) 2 to act as a secondary electron generator and generate secondary electrons ($e^-$) in response to incoming ions (+charged ions in this example) which are incident on the MCP 2. The ions arrive after separation in a mass analyser of a mass spectrometer. The MCP in this example is a Hamamatsu F2222-21 without its usual phosphor screen. The MCP 2 is located in a vacuum environment 7, e.g. the vacuum environment of a TOF mass spectrometer. The rear of the MCP 2 from which secondary electrons are emitted in operation faces a scintillator in the form of a phosphor screen 4 (model El-Mul E36), which emits photons of nominal wavelength 380 nm in response to electron bombardment by the electrons. Herein, the terms the front or front side of a component means the side closest to the incoming ions (i.e. the upstream side) and the rear or rear side of the component means the side furthest from the incoming ions (i.e. the downstream side). The phosphor screen 4 is supported on its rear side by a substrate 6 in the form of a B270 glass or quartz block of thickness 1 to 2 mm with the phosphor thereby facing the MCP 2. The quartz substrate 6 is transparent to photons of 380 nm. The phosphor screen 4 in turn has a thin charge detection layer 8 of a conductive material, in this case of metal, on its front side facing the MCP 2. The distance between the rear side of the MCP 2 and the front side of the metal layer 8 is 13.5 mm in this embodiment. The combined thickness of the phosphor screen 4 and metal layer 8 is about 10 μm. The charge detection layer 8 should preferably have some electrical conductivity so a metal layer is ideal, it should preferably allow at least some transmission of electrons to the phosphor screen and it should ideally reflect photons which are generated in the phosphor screen. Other properties of the charge detection layer 8 include that is should be coatable onto the phosphor screen and doesn't evaporate in vacuum (i.e. is vacuum compatible). In this embodiment, the metal charge detection layer 8 is a 50 nm thick layer of aluminium which is thin enough to be transparent so that the secondary electrons may pass through to the phosphor 4. The metal charge detection layer 8 helps to protect and dissipate charge build-up on the phosphor as well as re-direct any photons back toward the photon detector. The charge detection layer 8 also functions in the present invention as a charge detection electrode or charge pick-up and thus as a first detector of the detection system.

The substrate 6 is conveniently used in this example as separator between the vacuum environment 7 in which the vacuum operable components such as the MCP 2, metal layer 8 and phosphor 4 are located and the atmospheric environment 9 in which a photon detector 12 and data processing system 20 are located as hereafter described. For example, the substrate 6 may be mounted in the wall 10 of a vacuum chamber (not shown) within which chamber are located the vacuum operable components.

Downstream of the phosphor screen 4 and its substrate 6 is a photon detector in the form of a photomultiplier tube (PMT) 12, which in this embodiment is model no. R9880U-110 from Hamamatsu. The rear side of substrate 6 is separated from the front side of PMT 12 by a distance of 5 mm. The PMT 12 forms a second detector of the detection system. It will be appreciated that the PMT 12 is an inherently higher gain detector than the charge detection electrode 8, e.g. by a factor of 3,000 to 5,000 in this case. More generally, the higher gain detector might have a gain which is higher than the gain of the lower gain detector by a factor of 1,000 to 100,000 ($10^5$). This is derived as follows. The phosphor in this example has an amplification ratio 1-10 depending on kinetic energy. The PMT in this example normally works at $10^6$ gain but for this detector example works at 1,000-10,000 gain. In other words one electron before the phosphor is converted to 1,000-100,000 electrons after the PMT. In other embodiments, the higher gain detector might have a gain which is higher than the gain of the lower gain detector by a factor of, e.g., 1,000 to 1,000,000, or up to 10,000,000, or more.

It is also the case that the saturation levels of detectors 8 are 12 are different with PMT detector 12 typically becoming saturated at a lower level of ions arriving at the detection system than detector 8.

In operation, the incoming ions, which in this example are positively charged ions (i.e. the apparatus is in positive ion detection mode), are incident on the MCP 2. It will be appreciated, however, that by using different voltages on the various components the apparatus may be set up to detect negatively charged incoming ions. In a typical application, such as TOF mass spectrometry, the incoming ions arrive in the form of an ion beam as a function of time, i.e. with the ion current varying as a function of time. The front (or incident) side of the MCP 2 is biased with a negative voltage of −5 kV to accelerate the positively charged incoming ions. The rear of the MCP 2 is biased with a less negative voltage of −3.7 kV so that the potential difference (PD) between the front and rear of the MCP is 1.3 kV. Secondary electrons ($e^-$) produced by the MCP 2 are emitted from the rear of the MCP. The MCP 2 has a conversion ratio of ions into electrons of about 1000, i.e. such that each incident ion produces on average about 1000 secondary electrons. In positive ion detection mode as in this example, the metal detection layer 8 is held at ground potential so that the PD between the MCP 2 and the layer 8 is 3.7 kV. Changes in the charge at the metal detection layer 8 induced by the secondary electrons which travel through it are picked-up and generate a detection signal 22 which is sent to the first input channel (Ch1) of the data processing system 20.

The arrangement of the invention enables substantially all of the incoming ion beam which enters the MCP 2 to be utilised to generate secondary electrons. The secondary electrons have sufficient energy to penetrate the metal detection layer 8 and strike phosphor screen 4 and produce photons which in turn travel downstream, aided by reflection from metal detection layer 8, to be detected by PMT 12, the secondary electrons being detected by the detection layer 8 and the signal thereby passed to channel Ch1 of the data processing system 20. The arrangement of the invention enables substantially all of the secondary electrons from the MCP 2 to be used to produce photons from the phosphor 4. Thereafter, substantially all of the photons may be detected by the PMT 12. A detection signal 24 outputted from PMT 12 is fed to the input of second channel (Ch2) of the data processing system 20.

Briefly, the data processing system 20 comprises a 2-channel pre-amplifier 13, or two pre-amplifiers (one for each separate detection channel), wherein the detection signals 22, 24 are respectively pre-amplified in the separate channels Ch1 and Ch2. The 2-channel pre-amplifier 13, or two pre-amplifiers, is followed by a 2-channel digitiser (ADC) 14, or two ADCs (one for each separate detection channel). Where two pre-amplifiers or two ADCs are used, these are typically integrated into one PCB or even (pair-wise) into one chip (i.e. one component comprising two pre-amplifiers, and/or one component comprising two ADCs). One preferred design is to have two separate pre-amplifiers (because they typically are slightly different) and one dual-channel ADC together on one PCB. The pre-amplifier 13 is used between each of the detectors 8 and 12 and the digitiser 14 so that a gain of the detections signals 22, 24 can be adjusted to utilise the full range of the digitiser 14. The pre-amplifier has a gain 1-10. The pre-amplifier gain in this example is set to 1 for both the high gain signal 24 and low gain signal 22. An amplified signal means that it cannot be easily corrupted by noise during transfer. In embodiments where the preamplifier and the digitiser are directly connected it is possible that the signals will not need amplification.

The digitiser 14 in this example is a Gage Cobra 2 GS/s digitiser operated with two channels, Ch1 and Ch2 operating at 1 GS/s. Each of the channels Ch1 and Ch2 samples a separate detector, e.g. Ch1 for the charge detector 8 and Ch2 for the PMT photon detector 12. Accordingly, Ch1 provides a low gain detection channel and Ch2 provides a high gain detection channel.

The pre-amplifier 13 and digitiser 14 form part of a data processing system 20, which also comprises 2-channel data processing devices shown generally by unit 15. The data processing devices 15 are for performing data processing steps on the detection signals such as noise removal and ultimately merging the detection signals to produce a mass spectrum of high dynamic range. The data processing devices 15 include an instrument computer which is able to control components of the mass spectrometer and/or the detections system. In FIG. 1 the voltages applied to the MCP 2 and PMT 12 for example are shown controlled by the data processing system, i.e. an instrument computer thereof, via suitable controllers (not shown). In this way the gain on detectors 8 and 12 may be independently controlled. The data processing system 20 and its data processing devices 15 are described in more detail below and with reference to the other Figures.

The instrument computer of unit 15 may also be optionally connected (connection not shown) to a controller of the source of the incoming ions, e.g. ion source of the mass spectrometer, so as to be able to control the current of incoming ions as well as the energy of the ions. It will be appreciated that instrument computer of unit 15 may be operably connected to any other components of the mass spectrometer and/or detection system in order to control such components, e.g. any components requiring voltage control.

The constructed mass spectrum and/or any selected raw, part-processed or processed detection signals may be outputted from the data processing system 20, e.g. via a VDU screen 17 for graphical display of acquired and/or processed data or spectra, and typically outputted to an information storage system (e.g. a computer-based file or database).

Figure 1A:
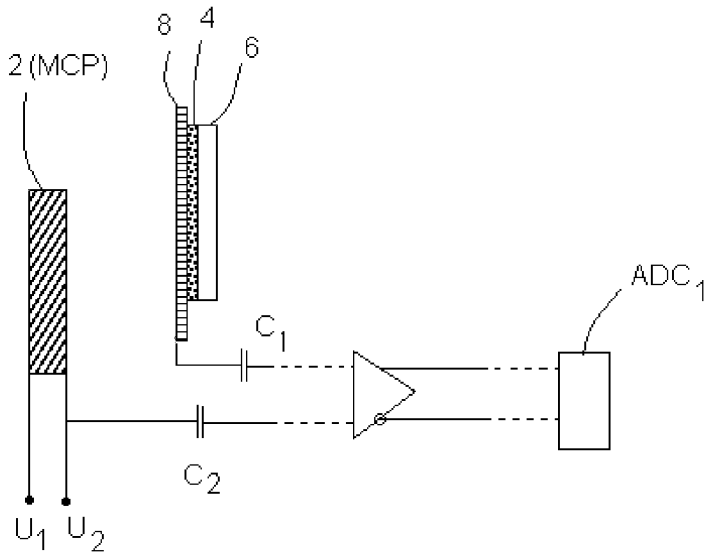
FIG. 1A shows schematically an embodiment of differential signal detection in a first detection channel.
Figure 1B:
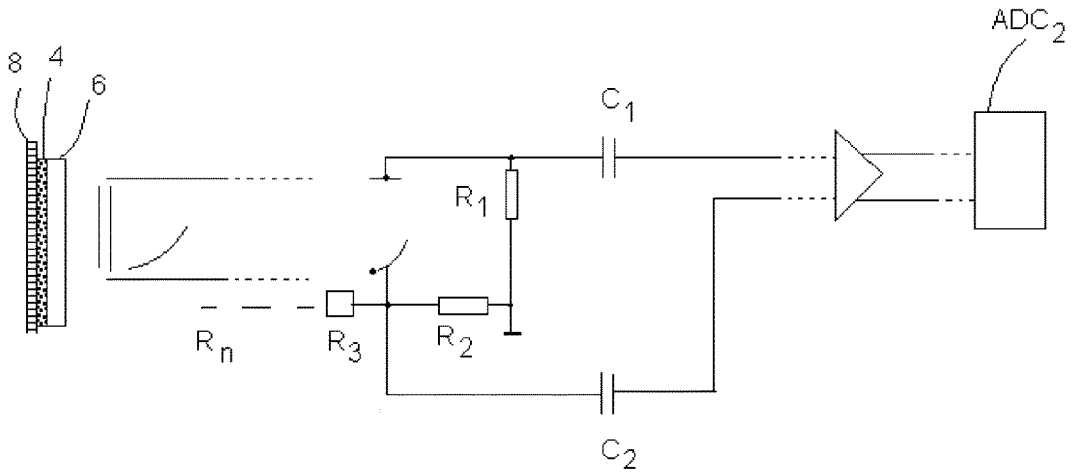
FIG. 1B shows schematically an embodiment of differential signal detection in a second detection channel.

A preferred method of detection signal transmission from the detectors to the pre-amplifier and digitiser comprises a differential pick-up, giving the benefit of a doubled signal magnitude. FIG. 1A shows an embodiment of such a differential pick-up and how the first detection signal may be realized at the charge collection/MCP stage and transmitted to Channel 1 (Ch 1) of the ADC. Each electron incident on the metal detection layer 8 has emanated from the rear (i.e. downstream) side of the MCP 2. Accordingly, a signal from each of the detection layer 8 and rear of MCP 2 form a complementary pair that is ideally suited for differential detection. The signal from each of the detection layer 8 and rear of MCP 2 is thus input to a differential amplifier as shown in FIG. 1A. Misbalances in the signals can be compensated by appropriate choice of capacitors C1 and C2 as shown or of other components not shown in the signal path (e.g. somewhere within the dotted lines). Similarly a differential signal may be picked up from the last dynode and the anode of the photomultiplier (or any SEM) as shown in FIG. 1B. Signal balancing can again be done, e.g. by resistors R1 and R2 (unless prohibited by other considerations, the supply voltage U could also be injected at a different point), by capacitors C1 and C2 and/or further downstream in the signal path. Induction can also be used for isolation.

Figure 2:
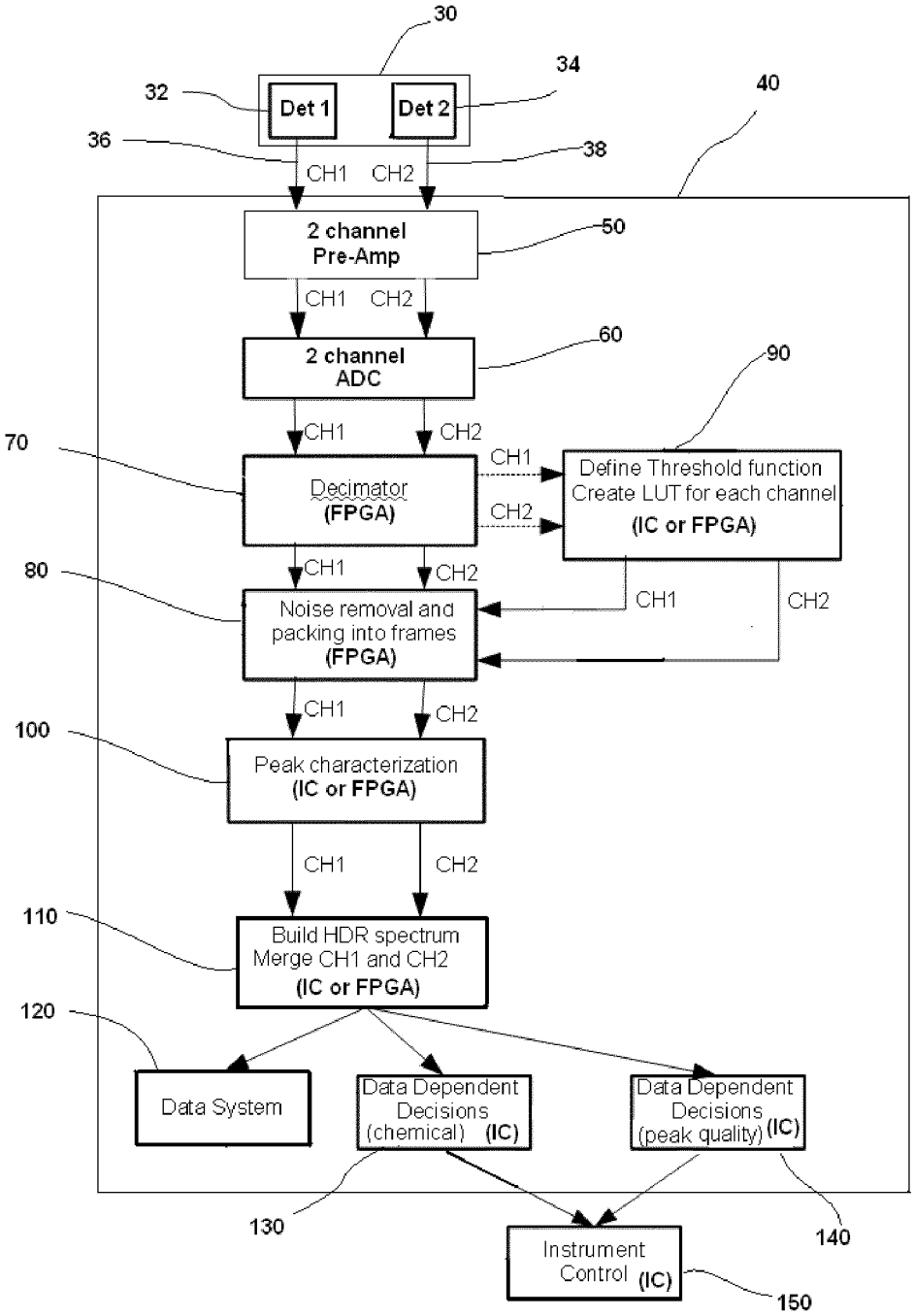
FIG. 2 shows a schematic representation of an embodiment of the present invention, including examples of data processing steps.

A summary of the data processing stages of the invention is provided next by reference to FIG. 2. Further details of each of the data processing stages of the invention are subsequently provided by reference to FIGS. 3 to 9. Referring to FIG. 2, there is shown a schematic representation of an embodiment of the present invention, including examples of data processing steps in a data processing system. A TOF detection system 30 for detecting arriving ions is shown which comprises two detectors 32, 34. The detection system 30 may be the same type of detection system as the detection system shown in FIG. 1 or it may be any other suitable detection system in which two detectors are employed, e.g. employing two MCP detectors or two PMT detectors. The detectors 32, 34 are preferably different to each other, at least in having different saturation levels and/or different gain. The detectors 32, 34 output detection signals 36, 38 respectively in separate channels, CH1 and CH2 respectively, in response to one or more ions arriving at the detection system 30 from a TOF mass analyser. It will be appreciated that the system may be employed to detect ions arriving other than from a TOF mass analyser, e.g. from another type of mass analyser. Preferably the detectors 32, 34 are of different gain so that the detection signals 36, 38 produced are of different gain even prior to the following pre-amplification, although this need not be the case The detectors are provided to enable detection channels of different sensitivity, which means that the total amplification chain (prior to and following pre-amplification) of the more sensitive detector will lead to more detection "signal" (or bits) per incoming ion than that of the less sensitive detector. Detector 34 in this case is preferably a high gain detector and detector 32 a low gain detector, especially they are high and low gain detectors respectively as described and shown with reference to FIG. 1. However, the high gain detector 34 saturates before low gain detector 32 for a given ion arrival rate at the detection system. Detector saturation means its response is no longer linear.

The detection signals 36, 38 are output from the detectors 32, 34 in the separate channels CH1 and CH2 to a data processing system 40, which is a two channel processing system for independently processing the signals 36, 38 in parallel in the channels CH1 and CH2. The detection signals 36, 38 are initially output to respective inputs of a two channel pre-amplifier 50 of the data processing system so that the signals 36, 38 remain in the separate channels CH1 and CH2 for pre-amplification. The pre-amplifier is thus placed close to the detectors in this arrangement and adjusts the gain so that the full range of the following ADC is utilised. The signals 36, 38 are preferably pre-amplified by different gains. In this example, detection signal 36 is of low gain relative to the detection signal 38 but in some other examples detection signal 36 may be of high gain relative to the detector 38. One output polarity exists after the pre-amplifier which utilises in a more efficient way the differential input of each ADC channel.

The amplified detection signals 36, 38 are then output separately from the amplifier 50 via respective outputs to respective inputs of a two channel analog-to-digital converter (ADC) 60 so that the signals 36, 38 remain in the separate channels CH1 and CH2 for digitisation. The ADC 60 is a 2 GS/s digitiser with the two channels CH1 and CH2 operating at 1 GS/s.

The digitised detections signals 36, 38 are then output separately from the ADC 60 via respective outputs to respective inputs of a decimator 70. The decimator is preferably implemented on a dedicated processor such as an FPGA (as shown) or other dedicated processor as herein described. Therefore, in other embodiments, instead of an FPGA an alternative dedicated processor for on-the-fly parallel computations such as a GPU or Cell for example may be used. The decimator 70 reduces the sample rate of the detection signals 36, 38, typically by a factor of 2 or 4 as desired.

After decimation, the signals 36, 38 continue to be processed separately with the next stage being noise removal and packing into frames, shown by noise removal and packing module 80. Noise removal and packing are preferably implemented on the dedicated processor (e.g. FPGA etc.) which is preferably used to implement the decimator 70, although this need not be the case as a separate dedicated decimation hardware may be used which is separate to the dedicated processor for noise removal and packing. Noise removal is performed first followed by packing into frames. Each detection signal 36, 38 is subject to noise removal comprising applying a threshold function to it, the threshold function being in the form of a look-up-table (LUT). The noise removal comprises applying separate threshold functions to the detection signals 36, 38, so there is a separate LUT provided for each of the channels CH1 and CH2. The noise removal and packing module 80 is supplied with the LUTs which have been created by a threshold calculator 90. The threshold calculator 90 may be implemented on the same dedicated processor as preferably used to implement the decimator 70 and noise removal and packing module 80. This is the case when the LUT needs to be created on-the-fly, especially if a new LUT needs to be created every time, i.e. for each new detection signal. In such cases the decimated detection signals 36, 38 are fed in the separate channels CH1 and CH2 as shown by the dotted lines to the threshold calculator 90 on the dedicated processor for the creation of separate LUTs for each channel. The resultant created LUTs reside on the dedicated processor in the separate channels CH1 and CH2 for noise removal. It is possible to implement two or more of the decimator 70, noise removal module 80 and threshold calculator 90 on different dedicated processors (e.g. different FPGAs, GPUs, and/or Cells etc.) but this is not preferably from an engineering perspective since the bus that would connect the separate processors could become a bottle neck on the bandwidth. Preferably, the threshold calculator 90 is implemented not on the dedicated processor but on an instrument computer (IC), which typically comprises a general purpose computer such as a multi-core processor, CPU or embedded PC for example. The LUTs, a separate LUT for each channel CH1 and CH2, created on the IC are then uploaded to reside on the dedicated processor for access by the noise removal module 80. This is especially the case where a LUT is initially to be calculated and then used for noise removal on a plurality of following detection signals. The LUTs created on the IC are initially calculated from the detection signals or mass spectrum. The threshold and LUT calculation and the noise removal and packing steps are described in more detail below.

After noise removal from the detection signals 36, 38 and packing the them into frames, the signals 36, 38 continue to be processed in the separate channels CH1 and CH2. Following noise removal and packing, the processing preferably comprises characterising peaks in the detection signals 36, 38 in the separate channels CH1 and CH2 by a peak characterisation module 100. The operation of the peak characterisation module 100 typically is different for the two channels. The peak characterisation is preferably implemented on the instrument computer (IC) but in some embodiments may be implemented on a dedicated processor (if so, preferably on the same dedicated processor as used for the foregoing steps of e.g. decimation, noise removal, packing, and/or threshold calculation). The peak characterisation preferably comprises computing one or more quality factors and the centroid of the peaks. Further details of the peak characterisation are described below.

After peak characterisation, each of the resultant processed detection signals 36, 38, preferably as centroid-intensity pairs, is transferred in separate channels CH1 and CH2 to a spectrum building module 110. The spectrum building module 110 performs merging of the processed detection signals 36, 38 into a single merged mass spectrum, preferably of high dynamic range. A plurality of merged mass spectra obtained in this way may be summed to form a final mass spectrum. The spectrum building module 110 is preferably implemented on the instrument computer (IC) but in some embodiments may be implemented on a dedicated processor (if so, preferably on the same dedicated processor as used for the foregoing steps of e.g. decimation, noise removal, packing, and/or threshold calculation). A plurality of detection signals 36, 38 in each channel CH1, CH2 may be summed before merging the processed detections signals 36, 38. Such summing may be performed at any stage of the processing between decimation and merging the detection signals. Such summing, where performed, is preferably implemented on the instrument computer (IC) but in some embodiments may be implemented on a dedicated processor (if so, preferably on the same dedicated processor as used for the foregoing steps of e.g. decimation, noise removal, packing, and/or threshold calculation). Further details of the spectrum building module 110 and the steps involved in merging the processed detection signals 36, 38 are described below.

The merged mass spectra are stored on a data system 120, such as a hard disk or RAM, e.g. for later access by the IC and/or another computer. The IC comprises a plurality of Data Dependent Decision Modules, e.g. 130, 140 which make decisions based on evaluation of the processed detection signals and/or merged mass spectra and control one or more parameters of the mass spectrometer based on those decisions via instrument control module 150. For example, the Data Dependent Decision Module 130 may control parameters which permit further chemical information to be obtained, such as control of the ion isolation window and width of a mass analyser which isolates a range of ions having m/z values within a specified window from a group of ions of broader m/z; control of ion injection time into the mass analyser; and/or control of collision energy of a collision cell (where present) and/or choice of the fragmentation method (if more than one available in the collision cell, e.g. CID, HCD, ETD, IRMPD). The Data Dependent Decision Module 140 may, for example, control parameters for the acquisition of the next detection signals which permit, e.g. a badly resolved peak to be acquired with higher quality in the next spectrum. The module 140 may use an evaluation of the quality factors associated with the peaks derived by the peak characterisation module 100. The modules 130, 140 may also perform self-monitoring functions such as detector recalibration, e.g. where saturation is detected in the detection signals. Modules 130, 140 and 150 are preferably implemented on the instrument computer (IC).

The data processing steps will now be described in more detail.

Figure 3A:
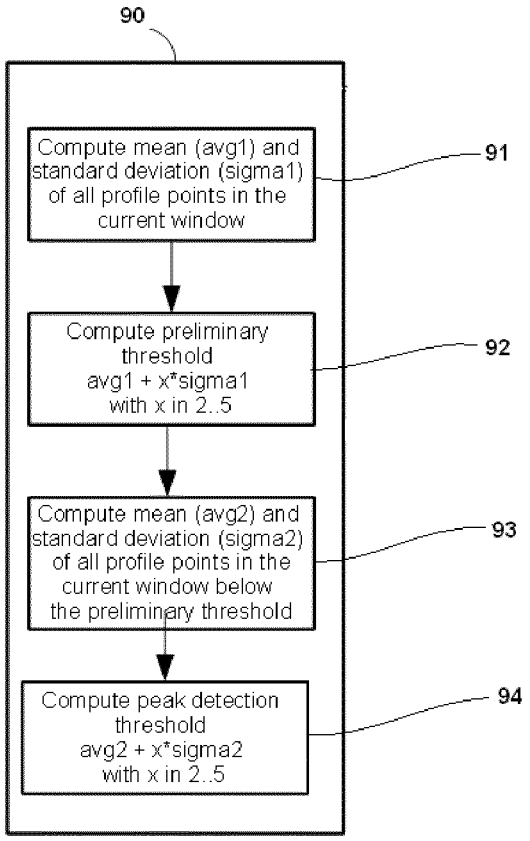
FIG. 3A shows a schematic flow chart of a preferred sequence of steps performed by the threshold calculator 90 of FIG. 2.

Referring to FIG. 3A, there is shown a schematic flow chart of a preferred sequence of steps performed by the threshold calculator 90 of FIG. 2. The threshold calculator 90 automatically determines a noise threshold. A separate noise threshold is calculated for each detection signal so that a separate noise threshold is calculated in each processing channel CH1 and CH2 in FIG. 2. The threshold is then used by the noise removal (i.e. peak detection) and packing module 80 shown in FIG. 2 which removes points below the threshold and retains points not below the threshold which are then recognised as peaks and subsequently are labelled with m/z values etc. The noise threshold may be determined by a method as disclosed in WO 2005/031791. The baseline of a TOF spectrum is not necessarily constant and to take this into account, a single threshold value is generally not sufficient. The noise threshold is preferably determined for a detection signal by the following steps:

1. dividing the detection signal into a number, n, of overlapping windows (where n is at least 2 and where n is thus typically the number of entries in the look-up-table (LUT));
2. selecting one of the windows as the current window;
3. determining for the current window at least one statistical parameter related to the noise of the detection signal from the intensity of the points in the current window;
4. determining a noise threshold for the current window from the at least one statistical parameter; and
5. repeating steps 2 to 4 for each of the other window(s).

The noise threshold for a window is assigned to a corresponding interval of the detection signal, e.g. the noise threshold for a window is assigned to an entry in the LUT which covers an interval of the detection signal, and all data points in that interval of the detection signal have that threshold applied to them to enable removal of points below the threshold. The intervals are non-overlapping so that each data point of the detection signal falls into only a single interval and has a single noise threshold applicable to it. The width of the intervals is the length or duration of the detection signal (transient) to be acquired divided by the size of the LUT (i.e. the number of entries in the LUT).

Thus, in a further aspect of the invention, there is provided a method of removing noise from a detection signal provided by a detection system for detecting ions in a TOF mass spectrometer, the method comprising:

i.) generating from the detection system at least one detection signal in response to ions arriving at the detection system;

ii.) dividing the or each detection signal into a number, n, of overlapping windows, where n is at least 2;

iii.) selecting one of the windows of the or each detection signal as the current window;

iv.) determining for the current window of the or each detection signal at least one statistical parameter related to the noise of the detection signal from the intensity of the points in the current window;

v.) determining a noise threshold for the current window from the at least one statistical parameter and assigning the noise threshold for the current window to a corresponding interval in the detection signal;

vi.) repeating steps iii.) to v.) for each of the other window(s) of the or each detection signal; and vii.) removing noise from the or each detection signal by removing points in each interval of the detection signal which have an intensity below the noise threshold for that interval.

An example of the at least one statistical parameter related to the noise is the mean intensity and the standard deviation from the mean of the points, preferably both. An example of threshold determination is as follows, for each overlapping window:

a) The mean intensity value of all points in a window is calculated ("$avg_1$");

b) The standard deviation value of the intensities of all the points in the window is calculated ($\sigma_1$);

c) A preliminary (i.e. first iteration) noise threshold, $T_1$, is calculated $=avg_1+x*\sigma_1$ where x is a multiplier value, typically from 2 to 5, preferably about 3;

d) The points below this preliminary threshold, $T_1$, are considered as noise points and points above this preliminary threshold are considered to be peaks;

e) The mean intensity value ($avg_2$) and standard deviation ($\sigma_2$) of these noise points are calculated in a second iteration, i.e. wherein the peaks detected in the first iteration are excluded;

f) A new (i.e. second iteration) noise threshold, $T_2$, is calculated as in a) to c) above from these second iteration $avg_2$ and $\sigma_2$ values, i.e. $T_2=avg_2+x*\sigma_2$;

g) Optionally one or more further iteration noise thresholds is/are calculated by repeating steps e) and f);

h) The second iteration noise threshold $T_2$ or optionally further iteration noise threshold is used for removing noise (i.e. detecting peaks) from the original detection signal to thereby provide reduced profile data, i.e. points of the original detection signal below this second, or optionally further, iteration threshold are considered as noise points and removed and points above this second iteration threshold are considered to be peaks and labelled with m/z and transferred as the reduced profile data for further processing;

i) The noise threshold (e.g. $T_2$) and noise avg (e.g. $avg_2$) and/or a (e.g. $\sigma_2$) values are preferably stored with the reduced profile data for further processing and analysis.

The thresholds for each respective window are independent of each other and can be calculated, as above, either in parallel or sequentially, preferably in parallel.

More than two iterations may be performed if desired to determine a third and/or further noise threshold. However, experiments have shown that the result does not significantly change with further iterations.

An extension of the method may comprise allowing only a certain degree of noise change between windows (or similar noise measurements, e.g. by comparison to a noise LUT generated using earlier data) to bridge regions with high peak densities where determination of a noise threshold might be difficult.

Thus the noise detection threshold is independent of peak height, and is only determined by the 'noise band' that can be viewed by eye in full profile data. It therefore is a direct measure of the noise band.

The noise threshold is thus a dynamic threshold which can vary with time along the detection signal, e.g. with time-of-flight in a TOF instrument, i.e. it typically varies between windows (intervals). The use of overlapping windows allows a larger number of windows to be used, more data to be used for the threshold determinations and hence a more accurate determination of the noise threshold, wherein discontinuities are reduced between intervals. Each window is assigned an entry in a look-up-table (LUT) and the threshold for each window is entered in the LUT entry for that window. In a preferred mode of operation, a full detection signal is recorded and the LUT is calculated in the above way from it and used for the noise removal from a plurality of, preferably all, following detection signals or spectra. The initial calculation of the LUT in such embodiments is thus preferably performed by the instrument computer, e.g. on a general purpose computer. The LUT is then uploaded to the dedicated processor which performs the noise removal by applying the LUT to the points of the detections signal. However, this approach may not be feasible if the noise differs significantly from scan to scan in which case the LUT is preferably calculated on-the-fly from each detection signal for comparison to detection signal from which it is calculated. On-the-fly calculations of the LUT are preferably performed on the dedicated processor. Subsequently, the method may comprise removing noise (i.e. conversely viewed as detecting peaks) in an interval by comparison of the points in that interval to the noise threshold for that interval and removing points falling below that threshold; and repeating this step of detecting peaks for one or more further intervals. That is, the points in a given interval are compared to the noise threshold held in the LUT entry for that interval.

Referring to FIG. 3A there is shown in the form of a flow chart, a sequence of steps for a determination of the noise thresholds for the LUT, i.e. a sequence of steps performed in the threshold calculator 90 of FIG. 2. For simplicity, the sequence of steps is shown for one channel, CH1 or CH2, of the data processing system but it will be appreciated that the same steps are independently performed on the other channel as well, preferably in parallel. Each detection signal is initially divided into a plurality of overlapping windows, each window slightly offset from its neighbouring windows. The plurality of windows may therefore be considered as a moving window of the given width. Each window then corresponds to a non-overlapping interval of the detection signal for which it provides a threshold value for noise removal. For example, for a detection signal (transient) of total duration 2 milliseconds (ms) and a LUT having approximately 1000 entries (e.g. 1024 entries), each interval will be approximately 2 microseconds (μs) wide. Since the windows are overlapping they are wider than the non-overlapping intervals and each window width is typically the width of the corresponding interval plus an overlap on both sides of the interval, the overlap part typically being 10% to 50% of the interval width but may be more or less than this. As an illustration, a section of a detection signal (transient) showing the positions of several overlapping windows and the corresponding intervals/entries in the LUT is shown in FIG. 3C. FIG. 3C shows a 10 μs section of a noisy transient 200. In this example, the total length of the transient is 1 ms and the threshold LUT has approximately 1000 entries, so each entry is dedicated to approximately a 1 μs interval of the transient, meaning that each threshold entry from the LUT will be applied to its own 1 μs interval of the transient. A number of such 1 μs intervals are indicated by reference 202 and by the thick horizontal bars 204, only some of which are referenced. Each interval 204 is assigned an entry 208 in the LUT which contains the calculated threshold for noise removal. To reduce discontinuities in thresholds between intervals, the windows actually used for the threshold computation are wider than the intervals (and neighbouring windows therefore overlap each other), as shown by the lengths of the thin horizontal bars 204' (only some of which are referenced) representing the overlapping windows, which span each interval 204 and overhang the ends of each interval. Each overlapping window is therefore associated with a narrower non-overlapping interval. Optionally the influence of the remote parts of the window can be reduced. One way to do that is to skip or reduce the weight of values that go into threshold computation depending on their distance to the window-centre. This can be done proportionally/linearly with the distance or using more complex functions e.g. a Gaussian curve. Another way to do that is to change the threshold computation function (see description of FIG. 3B) in such a way that more remote values have a lesser influence on the computed threshold. Again this can be done proportionally/linearly or using more complex functions.

Figure 3B:
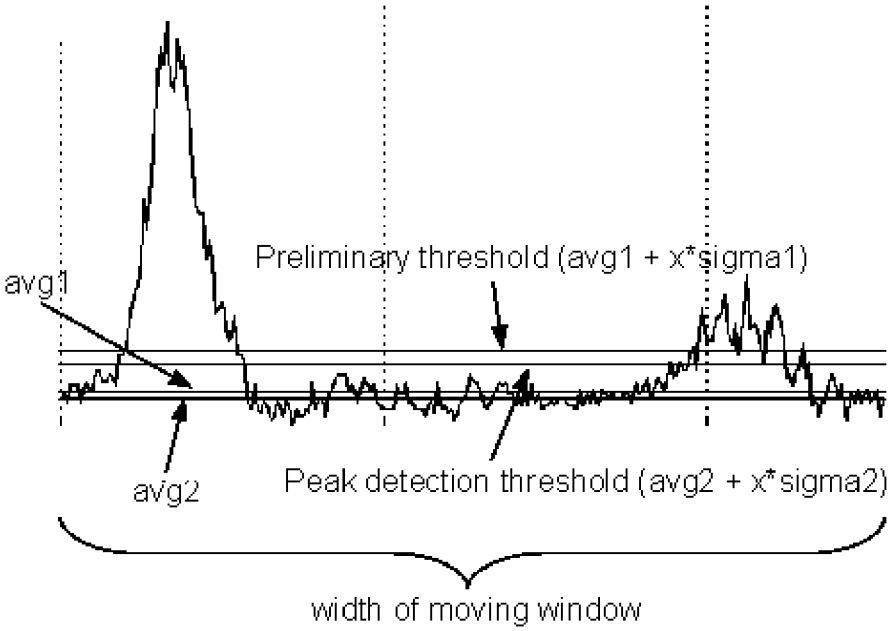
FIG. 3B shows a window on a detection signal used for determining a noise threshold and the position of the threshold.
Figure 3C:
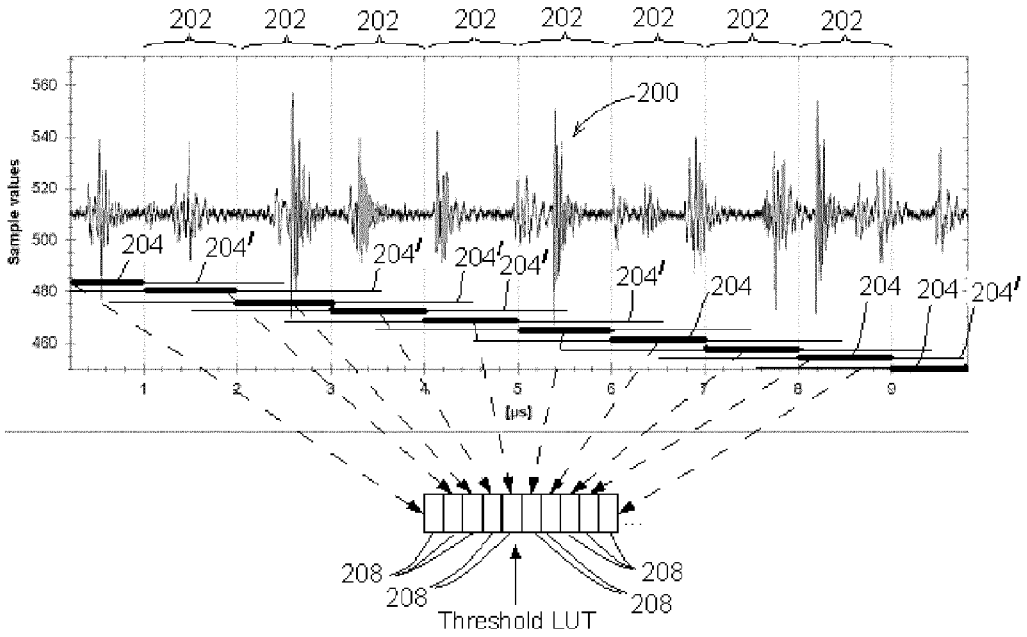
FIG. 3C shows a section of a detection signal and a plurality of windows and their corresponding LUT entries used for determining a noise threshold.

One of the overlapping windows for threshold calculation is shown in more detail in FIG. 3B. Referring again to FIG. 3A, firstly, in step 91, a mean intensity ($avg_1$) and standard deviation ($\sigma_1$) are calculated from all the points in the current selected window. Secondly, in step 92, a preliminary threshold $T_1$ is computed=$avg_1+x*\sigma_1$, with x typically being from 2 to 5. The position of the $avg_1$ and the preliminary threshold $T_1$ in the first window are shown in FIG. 3B. In the next step 93, a second mean intensity ($avg_2$) and standard deviation ($\sigma_2$) are computed using all of the points ("noise points") in the current window which have intensities below the preliminary threshold $T_1$. Lastly, in step 94, a peak detection threshold $T_2$ is computed from the detection signal=$avg_2+x*\sigma_2$. The positions of the $avg_2$ and the peak detection threshold $T_2$ are shown in FIG. 3B. As mentioned aboveach detection threshold value $T_2$, i.e. one for each window, is assigned an entry in a LUT and thereby is for applying to points in the corresponding interval of the detection signal. The LUT comprising all the detection thresholds $T_2$ is then used for noise removal from the original detection signal by removing points (i.e. noise points) in the intervals which have intensities below the corresponding threshold $T_2$ in the LUT. The points which remain in the detection signal after removal of the noise are considered to belong to peaks. The noise removal step is thus equivalent to a step of peak detection. Strictly speaking, the "noise" points are typically not totally removed at this stage but they are set to zero so they can be removed subsequently during the packing process, where every packing frame consists of only non-zero consecutive points and carries a position marker, as described in more detail below.

Figure 4:
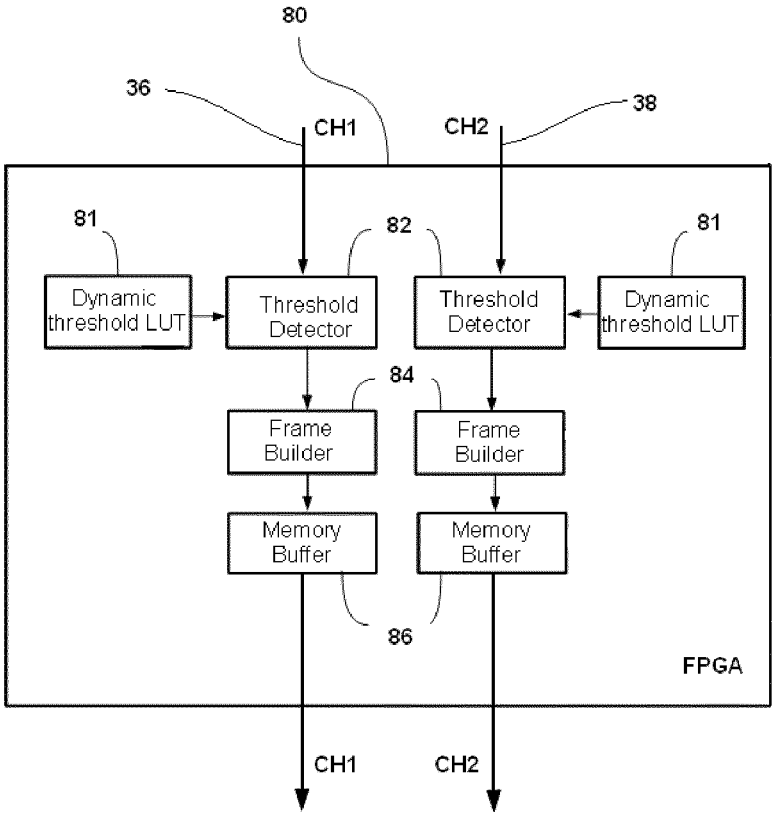
FIG. 4 shows a schematic flow chart of a sequence of steps performed in the noise removal and packing module 80 of FIG. 2.

The step of noise removal/peak detection is now described in more detail with reference to FIG. 4 in which there is shown, in the form of a flow chart, a sequence of steps performed in the noise removal and packing module 80 of FIG. 2, i.e. for noise removal using the noise thresholds in the LUT which have been generated as described above. Referring to FIG. 4 there is shown the two respective detection signals 36, 38 in their separate channels CH1 and CH2, which are input to the noise removal and packing module 80 via separate inputs from the decimator as described above with reference to FIG. 2. The noise threshold LUTs 81, one for each channel, computed as described above with reference to FIG. 3A-C, reside on the dedicated processor which implements the module 80 (e.g. FPGA, GPU, Cell processor etc.). A threshold detector 82 in each channel then applies the LUT for that channel to the detection signal and removes (sets to zero) points below the threshold defined by the LUT. Optionally the threshold detector 82 may be configured to keep data from all channels when a peak is detected in at least one of the channels, i.e. it removes a data point as noise only when the same point falls below the threshold in all channels simultaneously. The resultant reduced profile detection signals 36, 38 which emerge from the threshold detector 82 are then packed into frames by respective frame builders 84 for efficient transfer of point values of the detection signals. If a full profile mode of data acquisition is required, the LUT can be set to zero as the threshold so that all points of the detection signals are packed into frames, transferred for the further processing etc. If further processing is also to be performed on the dedicated processor, which is less preferred, the frame packing step may be omitted.

The frame builder 84 splits the detection signal into frames. These frames have a minimal and maximal size to use the bandwidth of the underlying bus system in the most effective way. A frame starts with the first point above or equal to the noise threshold (peak point). The actual frame size depends on the peak points: e.g. if only one peak point is above or equal to the threshold, the frame is filled with following peak points to reach the minimal frame size. If a wider peak follows this first peak point above or equal to threshold before the frame reaches its minimal size, it is possible that the frame grows above the minimal size as all the points of the peak are added to the frame. If a frame reaches its maximal size before a peak ends, the points of the peak continue with the next frame. In other words, a frame consists of the minimal size, unless a peak is present where the minimal size is reached in which case the frame is extended above the minimal size until the peak is finished subject to the frame not extending above the maximal size so that if the peak is present where the maximal size is reached the points of the peak continue in the next frame. A special case is when the system is operated in the full profile mode. In full profile mode, the complete LUT is set to 0, so all points are above or equal to the threshold, meaning that all frames except possibly the last frame have the maximal size, i.e. the points are packed into adjoining frames of maximal size.

Each frame preferably consists of a frame header and the actual point data. The frame header preferably carries the following information:

Start of frame delimiter
Format type description (Compressed or full profile, number of bits per point, packed or unpacked points)
Time stamp
Sequence Id (counts the acquired spectra)
Packet Id (counts the frames within a spectrum)
Packet size (number of points in the frame)

The frame may also contain the threshold, unless e.g. it is stored in another place (e.g. in a spectrum header). When using more than 8 bits per point, the points are packed (e.g. four ten bit points are packed into five bytes). The preferred mode of operation is a flexible frame width as explained above (i.e. employing the minimal and maximal frame size). It is also possible to use a fixed frame width, which would simplify the implementation but does not use the bandwidth of the underlying bus system in the most efficient way. Accordingly, each frame provided may contain one or several peaks and may contain a split-up peak (i.e. a peak split between two or more frames) as a result of the minimal and maximal packet length. The frames are stored e.g. in RAM, sequential access memory or a ring buffer in a memory buffer 86 near to the dedicated processor on each channel for further transfer and processing.

The packed frames of data are preferably downloaded (e.g. using Direct Memory Access (DMA)) from the fast processor (FPGA etc.) to the instrument computer, which may comprise for example a multi-core processor or embedded PC. The instrument computer then performs processes of peak characterisation. In some other embodiments, although less preferable, it may be possible to perform the processes of peak characterisation on the or another fast processor (FGPA, GPU, Cell etc.). It may also be possible to perform the processes on different processors but it is preferable (e.g. in terms of bandwidth) to implement the processes on the same processor, which is preferably the instrument computer.

The peak characterisation process will now be described in more detail with reference to FIG. 5 which shows the processes performed within the peak characterisation module 100 of FIG. 2. The instrument computer (IC) receives the packed frames of the detections signals 36, 38 in the respective channels CH1 and CH2. The IC preferably first converts the frames into peaks using a peak constructor 102 in each channel, i.e. it reads peaks from the frames and where split peaks are found in the frames it reconstructs the peaks from its split components. In an optional stage, in an optional peak adder 104, peaks from several detection signals are summed, e.g. peaks at the same TOF (+/−a tolerance) from different detection signals are accumulated to increase signal-to noise ratio. This summing process can be performed in parallel in the channels CH1 and CH2.

The peaks from both channels are then sent to queue 105 which consists of a plurality of data boxes 106 (only two of which are referenced in FIG. 5) wherein each box contains one peak and also any intermediate characteristic(s) computed from the peak needed for processing in a subsequent step to obtained further characteristics. However, each box will be associated with a particular channel so that each peak remains associated with its own channel. Each of the boxes 106 is preferably processed in parallel to each other.

One processing stage preferably performed on the peaks in boxes 106 is a peak evaluation 107 wherein various peak characteristics or attributes are computed, preferably including some, more preferably each, of: peak position, peak total width; peak full width at half-maximum (FWHM); peak area; peak maximum value; peak smoothness; and an overflow flag. The one or more quality factors may be based on one or more of the foregoing characteristics (or any combinations of any two or more thereof). An overflow flag is assigned to a peak where the peak exceeds the maximum ADC value. Peak area is preferably computed from the baseline. These peak characteristics are preferably computed in parallel for each peak and each peak is preferably processed in parallel. It will be appreciated therefore that, with reference to FIGS. 5 and 6, that parallel processing may be performed within each channel (as well as the separate channels being processed in parallel to each other), and such parallel processing within a channel may comprise, for example, processing different regions of the same detection signal in that channel in parallel, or doing independent tasks on the same region of the detection signal concurrently instead of sequentially.

Since the peak characteristics can be computed independently, there are two methods of computing them, either:

1. perform one pass over the data and compute all the characteristics at once; or 2. perform several loops over the data by using several threads computing a single peak characteristics each.

The preferred mode is method 1 because the second method would suffer from limited memory bandwidth. The method 2 is shown schematically in FIG. 6.

Another processing stage preferably performed on the peaks in boxes 106 is finding the centroids of the peaks using a centroider 108. Various methods may be used to find centroids including centroiding methods known in the art. For example centroiding methods may be used as described in: "Precision enhancement of MALDI-TOF MS using high resolution peak detection and label-free alignment", Tracy et al, Proteomics. 2008 April; 8(8): 1530-1538 (available at http://www.ncbi.nlm.nih.gov/pmc/articles/PMC2413415/); "How Histogramming and Counting Statistics Affect Peak Position Precision", D. A. Gedcke, Oretc™ Application Note AN58 (available at http://www.ortec-online.com/); U.S. Pat. Nos. 6,373,052 and 6,870,156.

Another processing stage preferably performed on the peaks in boxes 106 is a quality assessment using a quality assessor 109. Principally, the quality assessment comprises computing one or more quality factors for each peak. The quality factor may be computed in various ways. Preferred methods of computing the quality factor are now described. Other methods may be employed alternatively or additionally, such as described in U.S. Pat. No. 7,202,473 for example.

One preferred and simple approach for computing quality factors is to classify the peaks into different categories and assigned a different quality factor for each category, e.g. peaks can be classified in the following categories (in order of increasing quality factor):

1) Peaks from very small numbers of ions (<10 ions)

2) Peaks from small numbers of ions clustered (<500 ions)

3) Peaks from small numbers of ions (<500 ions)

4) Peaks from very large numbers of ions (>2000 ions)

5) Normal Peaks (500-2000 ions)

"Peaks from very small numbers of ions" are of limited mass accuracy because of ion statistics and so are given the lowest quality factor. "Peaks from small numbers of ions clustered" refers to peaks which are not evenly distributed throughout the expected peak area and appear as groups of peaks within a mass peak envelope. "Peaks from small number of ions" refers to peaks which have an even distribution and centroids can be reliably found.

Another preferred approach for computing quality factors is as follows. An overall quality factor for every peak can be computed from several simple individual quality factors (individual quality factors can be, for example: peak area/number of ions, peak smoothness, peak width etc.). Preferably, all the individual quality factors, as well as the overall quality factor, lie in the range 0.00-1.00, where 0.00 to 0.25 means poor quality, above 0.25 to 0.75 means acceptable quality and above 0.75 to 1.00 means excellent quality. If an overall quality factor is of poor quality, the peak is preferably re-acquired, especially with a high priority, if it is of marginally acceptable quality it is preferably also re-acquired but with low priority (i.e. re-do if possible). If a peak is still of low quality even after re-acquisition it may be discarded from inclusion in the merged spectrum.

The overall quality factor is preferably computed from the individual quality factors by using one or more of the following criteria:

- the mean of all individual quality factors (this is the most preferred mode of operation)
- the minimum of all individual quality factors
- the product of all individual quality factors
- the sum of all individual quality factors In the above methods, the same or different weighting may be given to the different individual quality factors when calculating the overall quality factor.

To be able to combine the different quality factors as described above, the same scale preferably must be used for each of them. The proposed scale is from 0.0 to 1.0. A function specific to each channel and each peak characteristics must be determined which can be done by a calibration.

The following individual quality factors in more detail are preferably used:

Peak Area (or Number of Ions):

In this quality factor, the area below the peak is used as a means to define the number of ions which have been detected.

Peak Smoothness

Figure 6:
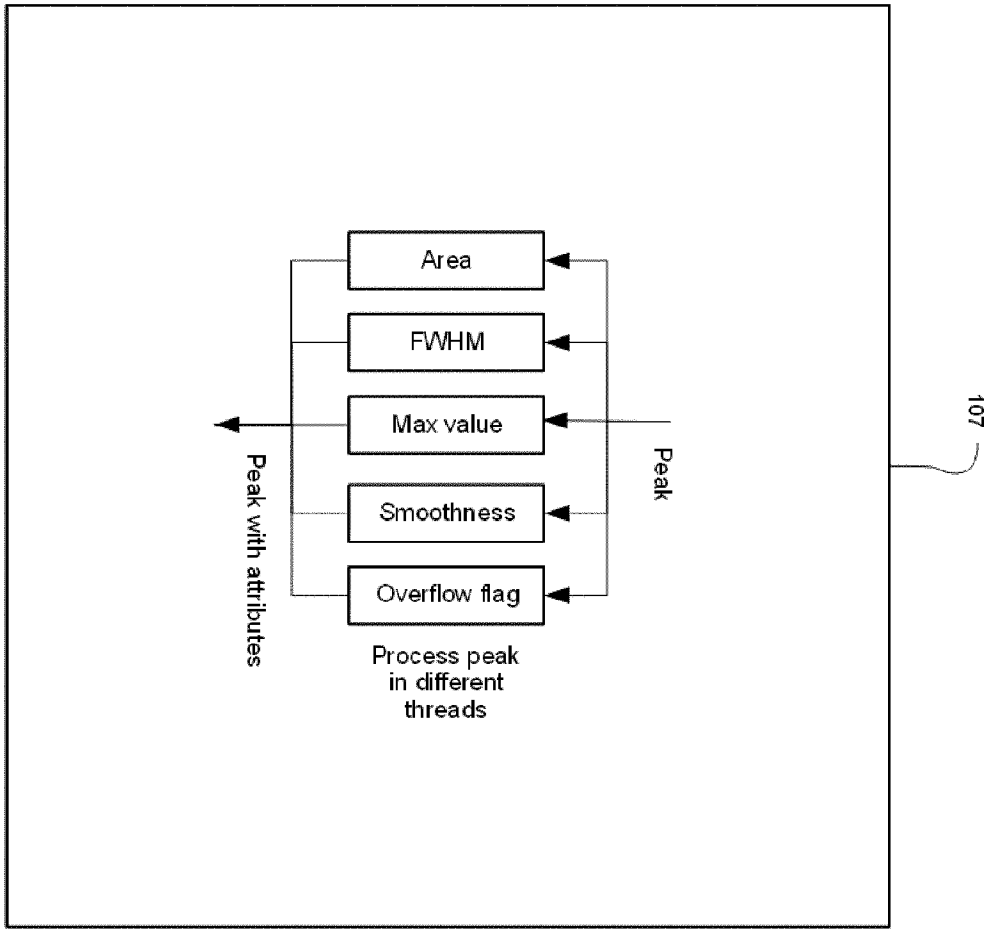
FIG. 6 shows schematically one method of peak characterisation.
Figure 6A:
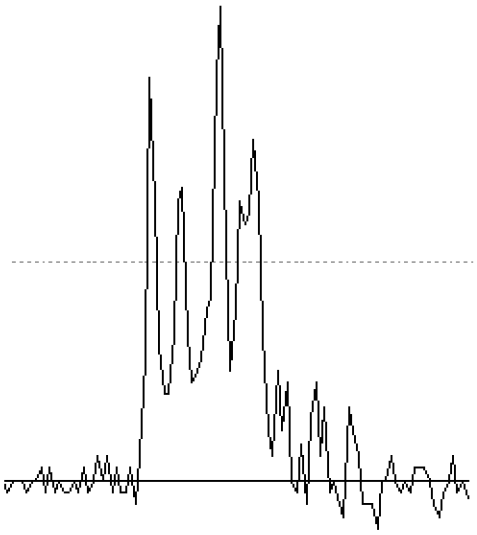
FIG. 6A shows a peak and a threshold for determining peak smoothness by the number of dips below the threshold.

In this quality factor, a mean for the smoothness (oppositely jaggedness) of a peak is preferably used. There are several ways to compute a mean for the smoothness of a peak, using for example:

- The ratio of the perimeter (i.e. circumference) of the measured peak and the perimeter of a parabola having the same area.
- The ratio of the perimeter of the peak and the perimeter of a Gaussian curve having the same area (preferred where peaks are more like a Gaussian curve).
- The ratio of the perimeter of the peak and the area of the peak
- The ratio of the number of dips below a threshold at x % of peak maximum and the width of the peak
- The ratio of the number of dips below a threshold at x % of peak maximum and the area of the peak With regard to the latter two methods, the FIG. 6A shows a peak and a threshold (dotted line) at FWHM position for determining peak smoothness. The peak shown has three dips below the threshold. The number of dips related to the peak width (or area) can be used as a measure for the smoothness of the peak. In some embodiments, the determined smoothness can then be compared to the expected smoothness.

Peak Width at x % of Peak Maximum

During calibration, the width of peaks at x % maximum is measured depending on the TOF and the number of ions. To determine a quality factor, the width of a peak at x % maximum is related to the width measured during calibration:

- The ratio of the width at x % maximum of the peak and the width at x % maximum measured during calibration at the TOF and number of ions (preferred mode of operation).
- The ratio of the width at x % maximum of the peak and the average width at x % maximum measured during calibration at the TOF.

Especially useful in this context are quality factors computed at the base of the peak (0% of peak maximum) and at the half maximum (FWHM) (50% of peak maximum).

In view of the above, an example of an overall quality factor determination comprises three individual or sub-quality factors: Peak Area, Peak Width (FWHM) and Peak Smoothness. The overall quality factor is then calculated from the three individual quality factors by averaging them with equal weight but in other embodiments different weighting could be used. The Peak Smoothness quality factor in the example is the ratio of circumferences of a model peak having the same area and width as the measured peak and the measured peak, using a parabola as the model peak. The circumference, s, of a parabola with a specific area and width is computed by the following function:

$$s = \sqrt{a^2 + 4h^2} + \frac{a^2}{4h} * arsinh\left(\frac{2h}{a}\right)$$

where $$a = \frac{w}{2}$$

$$h = \frac{3A}{4a}$$

w is the width of the peak and A is the area of the peak. The circumference of the measured peak, r, is computed by repetitively applying Pythagoras' theorem. The Peak Smoothness quality factor, $q_s$, is finally computed by the ratio of s and r:

$$q_s = \frac{s}{r}$$

The Peak Smoothness quality factor, $q_s$ is used directly because it is already in the range [0.0-1.0]. Nevertheless, it is possible to apply a calibration to this value.

For each of the Area and Width quality factors in the example, during a calibration process, a function is determined having the number of ions, the TOF and the variable to be calibrated (i.e. Area or Width). This function is then used to map the respective measured variable (either Area or Width of the measured peak) to a value [0.0-1.0]. A linear function is determined by the calibration, although other functions such as sigmoidal functions may be used for this purpose.

Figure 5:
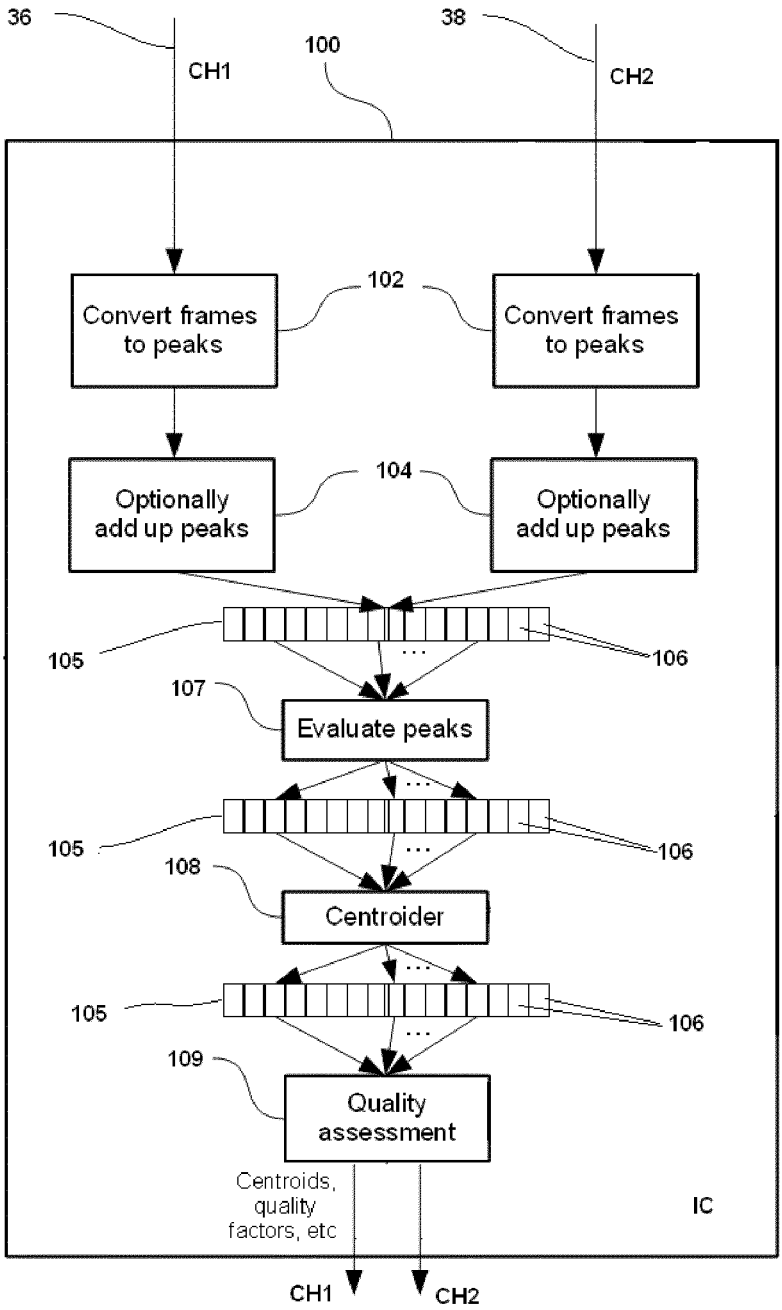
FIG. 5 shows a schematic flow chart of the processes performed within the peak characterisation module 100 of FIG. 2.

The processing stages 107, 108 and 109 have been shown in FIG. 5 as being performed in sequence but this need not be the case. It is preferable to perform each of the stages of processing 107, and 108 in parallel on the peaks in boxes 106. However, any of the stages 107, 108 and 109 may be performed sequentially (stage 109 depends on results of 107 and 108, so it must be performed after 107 and 108). It will be appreciated that where performed sequentially, the order of the processing stages 107, 108 can be different and that these stages can be performed in any order. The order shown with reference to FIG. 5 is merely one preferred embodiment.

Figure 7:
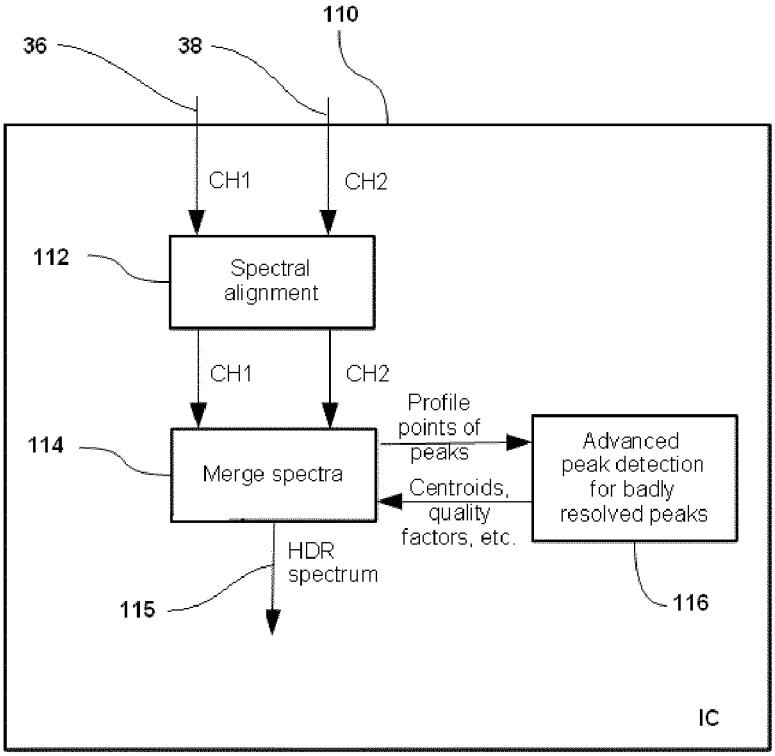
FIG. 7 shows a schematic flow chart of steps performed by the spectrum building module 110 of FIG. 2.

Following the processing of the detection signals the processed signals from each channel are merged to form a single spectrum, the steps of which are now described in more detail with reference to FIG. 7. FIG. 7 shows the steps performed by the spectrum building module 110 of FIG. 2. Due to the computational complexity of the steps to be performed, they are preferably implemented on the instrument computer. However, in some embodiments it is possible to implement the steps on the fast processor (FPGA etc.).

The processed detection signals 36, 38 from the peak characterisation module 100 are inputted in their separate channels CH1 and CH2 to module 110 and firstly to a spectral alignment module wherein the detection signals are aligned to compensate for any different signal starting points in time, especially important for TOF. A time offset is typically applied to one of the detections signals/channels to align them, i.e. one signal has to be moved on the time axis by an offset. The time offset is typically determined previously by a calibration step as described in more detail below, e.g. using an internal calibrant to align the detections signals/channels. It will be appreciated that in embodiments having three or more detection signals in separate channels that two or more of the signals will typically require a time offset to be applied to them to align all of the channels (and this may be a different time offset for each channel to which a time offset needs to be applied).

Once the detection signals have been aligned in time, they are merged to form a single spectrum. The spectrum is preferably one of high dynamic range (HDR) as now described in more detail. The two aligned signals, still in separate channels CH1 and CH2, are input to the merge module 114 wherein the merged (HDR) spectrum is generated. During this step, to further reduce the data rate, preferably only the centroids (with intensities) of the peaks of the detection signals are used so that centroid-intensity pairs of the detection signals are merged. Each peak in the HDR spectrum originates from one or other of the two processed detections signals 36, 38. The quality factor associated with the peak used in the HDR spectrum is further used in data dependent decision and instrument control modules 130, 140 and 150 shown in FIG. 2 and as described in more detail below.

Figure 7A:
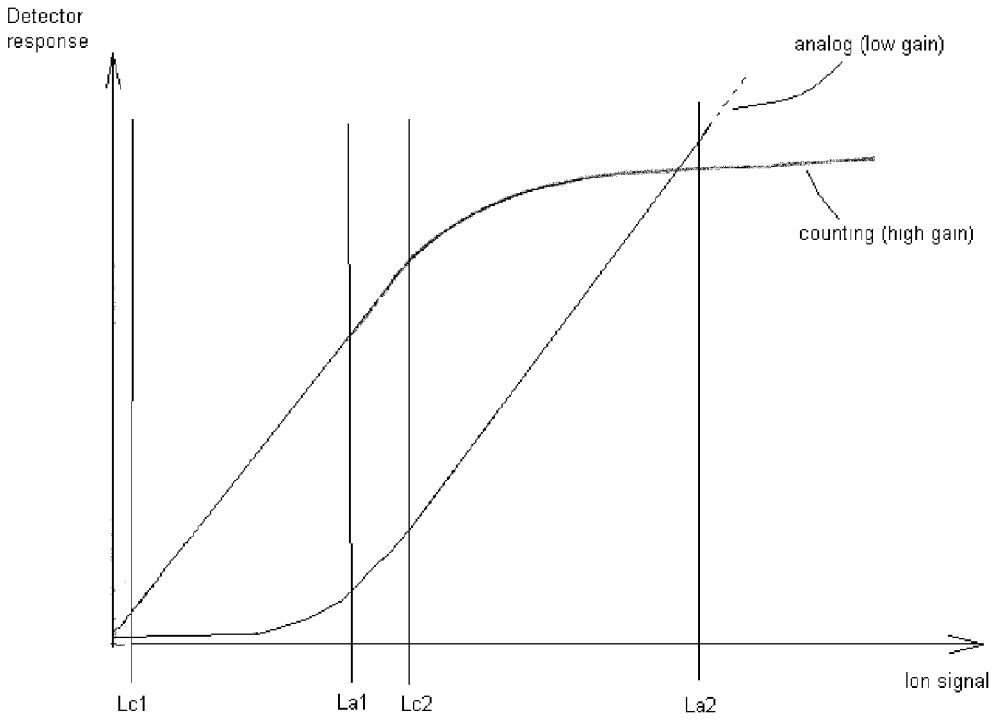
FIG. 7A shows the detector responses of the low and high gain detectors.

For the merged spectrum, the module 114 preferably uses the high gain channel CH2 i.e. signal 38 to provide the peaks for the merged HDR spectrum except where the high gain detection signal 38 is saturated (e.g. as detected from the presence of an overflow flag associated with the peak in the high gain detection signal 38). Where saturation of a peak occurs in the high gain channel CH2, the corresponding peak from the low gain channel CH1 and signal 36 is instead used for the merged HDR spectrum. For peaks in the HDR spectrum taken from the low gain channel CH1 and signal 36, the peaks are multiplied by a predetermined factor so that the intensity of the peaks match the amplification level of the high gain channel CH2 and signal 38 (i.e. the low gain peaks are multiplied by the amplification or gain ratio of the high gain channel to the low gain channel, the amplification being the result of the gain from both detector and pre-amplifier). The amplification factors of the two channels CH1 and CH2 are adjusted so that if the high gain channel saturates, the low gain channel supplies high quality peaks as described in more detail below in relation to the calibration. In summary then, the merged spectrum comprises the non-saturated peaks of the high gain channel and where a saturated peak occurs in the high gain channel the merged spectrum comprises the corresponding peak of the low gain channel multiplied by a factor representing the gain of the high gain channel relative to the low gain channel. A single merged HDR spectrum 115 is outputted from the module 114. Alternatively, the detection signals from the separate channels may be combined in the manner described in U.S. Pat. No. 7,220,970 or in any other manner known to those skilled in the art. In a variation of the foregoing, preferably no user interaction is required for ensuring that the system always chooses the detection signal with no saturation condition (linear response) to build the merged spectrum. In a further variation, especially another in which preferably there is no user interaction required for ensuring that the system always chooses the detection signal with no saturation condition, as shown in FIG. 7A, the system automatically detects the range where the low gain detector (e.g. an "analog" detector) and the high gain detector (e.g. a "counting" detector) have a "common" or "parallel" linear response (e.g. shown between the Levels La1 and Lc2), changes to the correct (linear response) detector outside this range and recalibrates the relative gain in the "common" or "parallel" range.

The processed detection signals and/or HDR spectrum are preferably stored on a data system such as system 120 shown in FIG. 2. The HDR spectrum may be outputted from the instrument computer in a tangible form such as on a graphical interface, e.g. a VDU screen, or on hard copy medium, e.g. paper.

Optionally, an advanced peak detection is performed for badly resolved peaks, e.g. for merged peaks or low intensity peaks, as represented schematically by advanced peak detection module 116 in FIG. 7. Preferably, the advanced peak detection processes are only performed where a peak has a low quality factor in both channels since the advanced peak detection is typically significantly computationally expensive. The detailed processes of the advanced peak detection stage 116 are shown schematically with reference to FIG. 8. Firstly, in the case of merged peaks which are poorly resolved, the peaks are split by the peak splitter module 117 using, e.g., known methods to splits peaks such as using a moving average (preferred), double Gaussian or modified wavelets. The advanced peak detection and preocessing may have to collect information from neighbouring boxes. The profile points of the poorly resolved peaks are fed to the peak splitter 117 to enable the splitting to be performed. Once the merged peaks have been split into individually resolved peaks (split peaks), the same steps of peak characterisation as shown in FIG. 5 are performed on the split peaks using boxes 106' for each peak etc. The split peaks are then transferred to the merged spectrum. Examples of preferred methods to split the peaks are now given.

In the case of so called double peaks, when two peaks appear close to each other or overlap, or when a broad peak appears (wider than an expected width), an algorithm checks if there is more than one maxima. Two cases are dealt with:

1.) Jagged Peaks Having Areas of Low Intensity. This is an indication that samples belonging to different peaks have been merged into one peak. The algorithm for detecting and splitting the different peaks in this case preferably comprises:
   a. computing a moving average (with a configurable width, i.e. a width of a number of profile points), i.e. computing an average intensity from a number of profile points of the peak in the chosen width;
   b. detecting the start of a peak where the moving average changes from below a threshold to above the threshold and detecting the end of a peak where the moving average changes from above threshold to below threshold;
   c. correcting the peak limits determined in step b. using the sample threshold from the LUT since the spatial resolution of the moving average decreases with increasing window width. After correction, the start of the peak is the first value above threshold and the end of the peak is the last value above threshold. By way of explanation, the peak limits that were determined by applying the threshold to the moving average are not as accurate as possible. This is because of the window size that was used to determine the moving average. The limits are corrected by finding the position where the samples are crossing the threshold on the end of the left peak and the beginning of the right peak of two merged peaks.

2.) Jagged Overlapping Peaks. For a peak that is wider than an expected width for the current time or m/z, it is assumed that this peak consists of two overlapping peaks. The expected width is described below. Peaks of this kind are split using the following algorithm:
   a. Find two maxima and a minimum between these maxima, wherein the maxima and the minimum can be determined in several ways, e.g.:
      i. using a centroiding method with a reduced width to find both maxima and determining the position of the minimum by searching for the minimal point value between the maxima; or
      ii. using a centroiding method with a reduced width to find both maxima and determining the position of the minimum by applying a centroiding method to the points between both maxima; or
      iii. using a moving average with an appropriate window width to find both maxima and the minimum in-between; and
   b. Split the peak at the position of the minimum.

In another type of embodiment, peaks are determined to be candidates of sufficient quality factor or not on the basis of a comparison of the peak shape with the shape of a model peak. In still another embodiment, peaks are to be deemed such candidates on the basis of comparison of both the peak height with the height of a local background of the detection signal data and on the basis of a comparison of the peak shape with the shape of a model peak.

In still another type of embodiment the decision whether peaks, especially those of low intensity, may be due to ions or not is based on predicting the intensity and the number of points above a detection threshold in the data on the basis of ion statistics.

A noise value is already available from the thresholding process, and thus a very simple peak quality factor may be S/T−C (where S=signal intensity, T=threshold (from Lookup-Table) and C a constant).

When a value between 0 and 1 is desired as the quality factor a sigmoid function may be used for conversion, e.g. the logistic function (with scaling A): quality factor, QF: $=0.5*(1+\tan h(A*(S/T-C)))$, where the function QF goes through ½ at position C.

The preferred scaling of the peak quality factor between 0 to 1 is also preferable because it allows easy integration of quality factors determined from probabilities. (like information from e.g. the method of Zhang et al. Bayesian Peptide Peak Detection for High Resolution TOF Mass Spectrometry, IEEE Transactions on Signal Processing, 58 (2010) 5883; DOI: 10.1109/TSP.2010.2065226).

In the embodiments where peaks may be determined to be candidates for being due to ions and are retained and other peaks are determined not to be due to an ion and are discarded on the basis of a comparison of the peak shape with the shape of a model peak, the model peak shape may be Gaussian, modified Gaussian, Lorentzian, or any other shape representative of the mass spectrometric peak. Such a peak shape can also be empirically determined from the data at hand, e.g. as an average measured peak shape. A modified Gaussian peak shape may be a Gaussian peak with a tail on one or both sides. The model peak shape may be generated from a base peak such as a parabolic peak shape then modified to better match measured peak shapes of ions. Preferably the model peak shape is Gaussian. The width of the model peak shape may be set from a predetermined or calculated parameter or more preferably is calculated from the measured data. Preferably the width of the model peak shape is a function of the mass, more preferably a linear function, whose width increases with increasing mass. Preferably the width of the model peak shape is determined from measured data generated from the ions as measured and is therefore determined on the basis of the instrument used for the mass analysis. It is known, however, that TOF peak shapes are usually not exactly Gaussian and that the exact peak shape may e.g. depend on intensity and mass, or even on the intensity of a preceding (i.e. lower mass, earlier arriving) peak. The inventors have found that peak position determinations in data of high quality and which have a high signal to noise ratio are usually not harmed by the use of a non-matching peak shape, but that on the other hand noisy data, where the peak detection and assessment method is most needed, are more reliably identified and positioned using a simple function, for example a Gaussian or a triangle. However, the additional degree of freedom of using for example a peak width that is a variable and individual to every peak typically leads to a worse position determination than a simple model where the width is only a function global to the complete spectrum. Preferably the model peak shape is Gaussian. Other convenient peak shapes that may be utilised to form the first model peak shape are parabolas and triangles. The properties of Gaussian peak shapes and distributions and their sums are very well known and favourable for most types of data analysis. Thus only very restrictive requirements to the computing times or very distinct knowledge of the precision of the measurements would suggest use of other than Gaussian functions.

The match between the shape of the identified peak and the model peak shape is preferably determined using a correlation factor (CF). Correlation factors are preferably determined between each of the identified peaks and the model peak shape, the correlation factor being representative of the match between the shape of each identified peak and the model peak shape. Preferably the correlation factor is a function of the intensities of the identified peaks and the model peak shape at a plurality of points across the peaks. A class of such functions includes sample correlation coefficients, e.g. at http://en.wikipedia.org/wiki/Correlation and dependence. Accordingly, in a preferred embodiment, the match between the shape of the identified peak and the model peak shape utilises an expression including a sample correlation coefficient.

Preferably, the function describing a correlation factor (CF) is of the form:

$$CF = \frac{n \cdot \sum_n (IM \cdot ID) - \sum_n IM \cdot \sum_n ID}{\sqrt{\left[n \cdot \sum_n (IM \cdot IM) - \left(\sum_n IM\right)^2\right] \cdot \left[n \cdot \sum_n (ID \cdot ID) - \left(\sum_n ID\right)^2\right]}} \quad \text{equation (1)}$$

where:

n=number of points across the identified peak and across the model peak shape;

IM=model peak shape intensities;

ID=measured intensities across the identified peak.

In this case, the number of points across the identified peak and the number of points across the model peak shape are chosen to be the same (i.e. n) and the intensities IM and ID are derived respectively from the model peak shape and the identified measured peak at each of the points, n. Preferably n is chosen to be the number of measured data points across the identified peak, i.e. such that the measured intensities across the identified peak ID are measured data points, requiring no interpolation.

Using the function of equation (1), a correlation factor set within the range 0 and 0.9 is used as a threshold to distinguish between identified peaks that may be due to background and identified peaks that are due to detected ions, preferably a correlation factor set within the range 0.6 and 0.8 is used, more preferably a correlation factor set within the range 0.65 and 0.75 is used, more preferably still the correlation factor threshold is set to 0.7. If the magnitude of the correlation factor is less than the threshold, the identified peak is taken to be due to background rather than due to detected ions.

Even when a correlation factor is not used during further processing it is very useful and preferred to use such a procedure of matching the data to a model peak to obtain an accurate position and height of a peak.

Another method of peak detection is to predict the expected number of data points above a threshold within a certain time window if the data is likely to represent a peak. The measured data is then examined and if the observed number of data points within similar time windows is significantly lower than predicted (e.g. half as many) all the data points within those time windows may be discarded as noise but preferably are only discarded once the signal at those positions is confirmed by at least one further scan (e.g. the points in a time window are not discarded if a peak in that time window is confirmed by other scans but are discarded if other scans don't show a peak in that time window either). The other scans for peak confirmation are preferably recorded close in time (e.g. close in a chromatogram) and acquired under comparable conditions.

The model peak shape described above is typically a function of mass and accordingly a different model peak shape is compared with each identified maximum where it occurred at a different mass. The comparison is then preferably made using a correlation factor as defined in equation (1). A threshold correlation factor of 0.6 is preferably used to filter identified maxima, with maxima having a correlation factor ≥0.6 being taken to be due to ions.

A statistically motivated algorithm is based upon the predicted number of consecutive data points in a mass spectral peak. This number can be calculated once the following values are known:

peak width.

Sample rate (data points per time unit)

S/N of the peak apex.

A peak candidate is only accepted if it has at least 70-100% (or so) of the expected (calculated) consecutive points in its mass trace.

One method of differentiating peaks which are likely to be from ions from those which are not likely to be from ions is to identify the expected number of data points above the detection threshold and reject peaks which have less data points as spurious. Traces with significantly more data points than expected are typically considered background.

The simplest method of doing this evaluation for spurious peaks is to discard single data points. These single points are usually called "spikes", and their removal is crucial if smoothing is used, because a smoothed spike looks exactly like a good peak.

Figure 8:
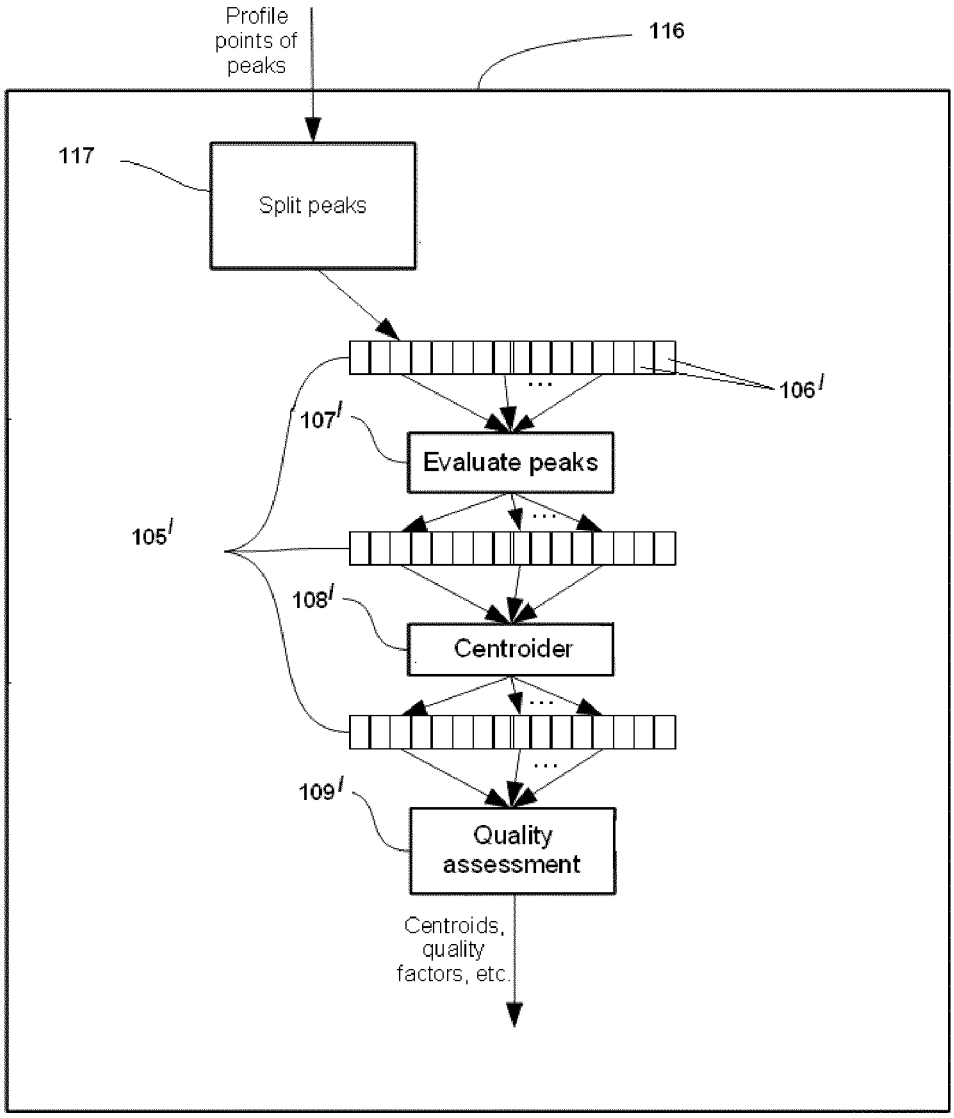
FIG. 8 shows a schematic flow chart of processes of the advanced peak detection stage 116 of FIG. 7.
Figure 8A:
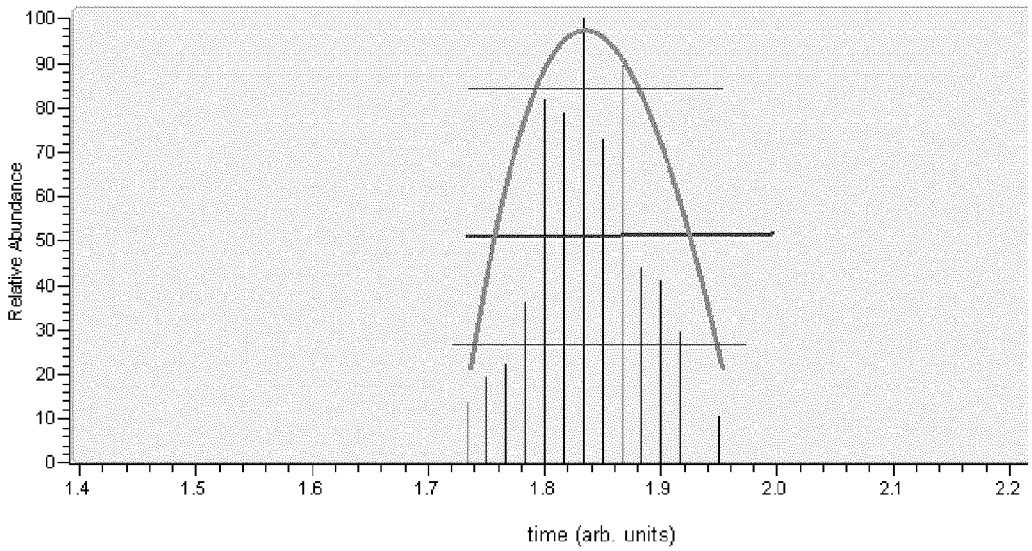
FIG. 8A shows a schematic example set of data points.
Figure 9:
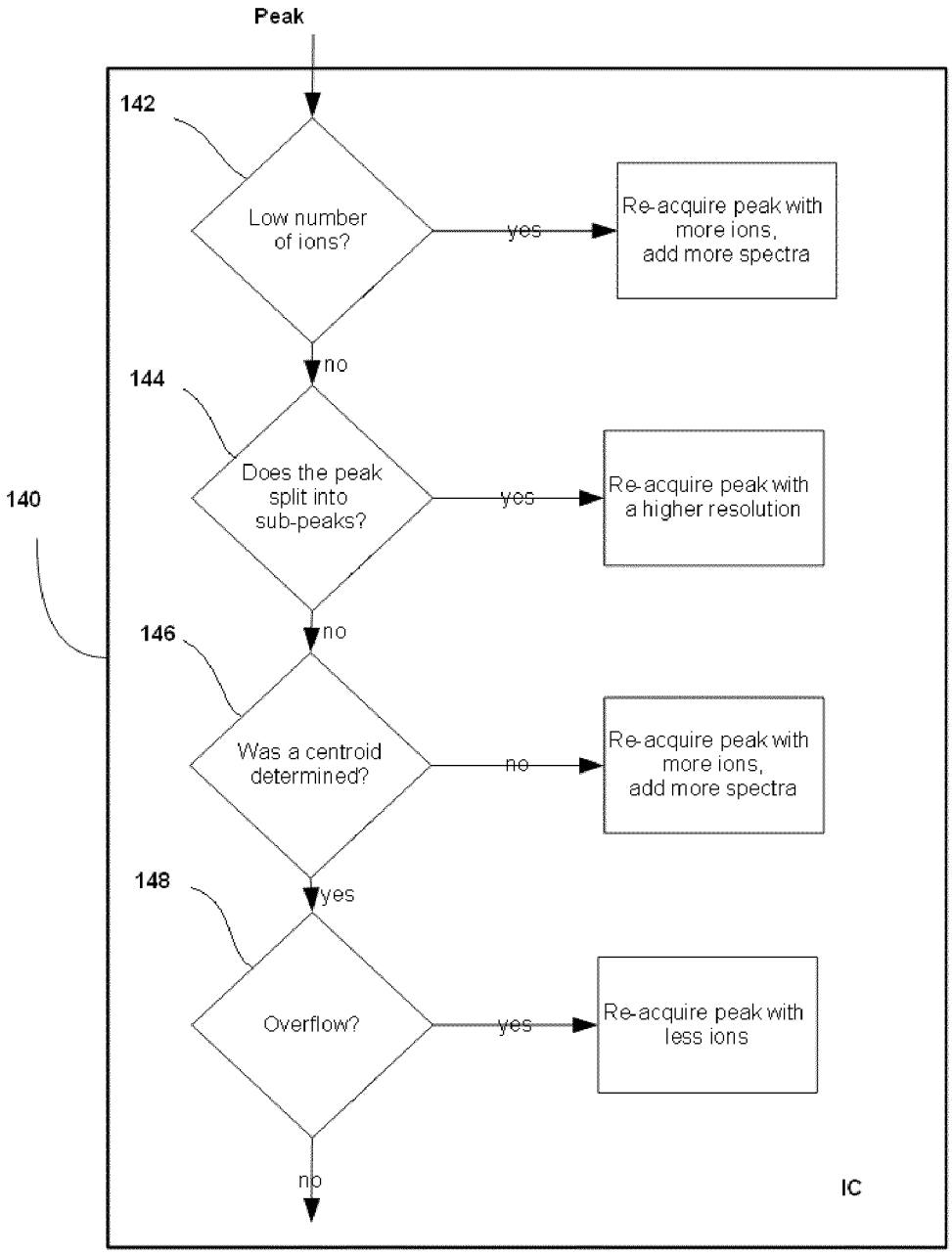
FIG. 9 shows a schematic flow chart of decisions which can be made by decision module 140 of FIG. 2.

More advanced differentiation methods may preferably make use of the model peak shape, which is typically anyway available for determination of the height and position of peaks. For convenience, we will term the height of the model peak as fitted to the measured data the "observed intensity" and the position of the model peak as fitted to the measured data the "observed peak position". Referring to FIG. 8A, there is shown a schematic example of a set of data points (as vertical bars, with height representing intensity) from a frame containing a peak candidate which has been extracted from a complete data set. The model peak shape is also shown. Then for a given detection limit (thick horizontal line) the number of data points above the detection limit may be counted (here: 5) and compared to the number of points above this detection limit expected from the model peak of the observed height and position (here: 9). Obviously the expected number of consecutive data points or of the number of data points above a certain limit depends on the relative height of the peak to the detection limit. In the example, a lower detection limit (lower horizontal line) would give more consecutive data points (9 observed, 11 expected) and a higher detection limit (lower horizontal line) compared to the peak height would give less data points (2 observed, 5 expected). A reasonable criterion to discard peaks would, for example, be that less than 75%, or less than 50%, of the expected number of data points above detection limit are actually observed.

For very low signal intensities ion statistical effects are preferably to be taken into account as well, since due to the statistical nature of the detection and ionization processes the number of observed ions varies randomly. This random variation is well researched. In many cases this variation follows for example Poisson statistics. In that case for example, the relative variation of the observed number of ions is the square root of the number of ions. The number of ions for a given signal strength (i.e. intensity or height) may be disclosed by an instrument manufacturer, determined by a calibration (see e.g. Makarov, A. & Denisov, E.: "Dynamics of Ions of Intact Proteins in the Orbitrap Mass Analyzer"; *Journal of the American Society for Mass Spectrometry,* 2009, 20, 1486-1495), generated from observations in the data set or derived from first principles, for example assuming Poisson statistics for the appearance of ions. Then for each data point the expected minimum and maximum intensity may be obtained and used to see how much the expected number of data points has to be reduced compared to the direct determination from the model peak. For example, when the intensity derived from the model peak is assumed to be 100%, and a significance level of 3 sigma is expected, the observed intensity of that data point may lie between 0 and 200% for 8 ions, between 24 and 175% for 16 ions, between 50 and 150% for 32 ions, etc. Thus, e.g., assuming that the most intense point in the peak profile would correspond to 32 ions, it is expected that the 5 data points vary by approximately +/−50% of their average intensity. Thus, even though less than 50% of the peaks expected from a simple comparison with the model peak are observed this peak would be deemed acceptable and not discarded.

The above methods may also apply to cases where there are more than two overlapping peaks, however this may be more difficult to deal with by the algorithm and instead it is preferred that the spectrometer should switch to higher resolving power (i.e. which requires that the spectrometer is capable of detecting such cases). It is also possible to employ a recursive version of the above algorithm, which continues to split either resulting peak if such peak is still wider than the expected peak width. An important alternative is to fit the minimum number of "model peaks" consistent with the peak width to the data.

An expected peak width is used by various algorithms described above and is preferably computed in the following manner. During calibration a known number of ions at different m/z that result in different flight times is introduced into the mass spectrometer. This process is repeated for different numbers of ions (i.e. corresponding to different peak intensities). A three dimensional plot with x-axis having flight time, y-axis having number of ions or area, and z axis having time width at FWHM (or more generally: at x % of maximum) is created. Alternatively, a multi-dimensional array with this information is created and interpolated values are obtained.

The time value of the points, i.e. the TOF, in the merged spectrum are preferably converted to m/z, although it will be appreciated that the detection signals themselves may be converted to m/z before merging to form the merged spectrum. Conversion to m/z is preferably performed using a method of calibration, e.g. as now described.

An external calibration, in conjunction with an internal calibration to boost accuracy, is preferable to convert time of flight to m/z. The external calibration has to be done in regular intervals to adjust for drifts on potentials and temperature as well as for aging effects of any electron multiplier and, primarily, any photomultiplier of the detection system. The external calibrant should provide several peaks distributed over the whole mass range. The measurement should be repeated several times with different total intensities. The number of peaks and the number of different intensities necessary to calibrate the instrument is dependent on its linearity. Several properties can be derived from such a series of measurements:

If the calibrant also contains peaks in different intensities, this can be used to compute the amplification factors for both channels. This information can be used for combining both channels as described above. For example, the amplification or gain factors, g1 and g2, may be computed from the following functions:

$$g1=\text{Area}(p1.ch1)/\text{Int}(p1)=\text{Area}(p2.ch1)/\text{Int}(p2)$$

$$g2=\text{Area}(p1.ch2)/\text{Int}(p1)=\text{Area}(p2.ch2)/\text{Int}(p2)$$

where

Area(p): area/intensity of a peak p

Int(p): intensity or abundance of the substance that results in peak p g1: gain of low gain channel g2: gain of high gain channel p.ch1: peak on low gain channel p.ch2: peak on high gain channel p1: peak which is saturated on the high gain channel and not saturated on the low gain channel p2: peak which is not saturated on the high gain channel For determining g1/g2, the formulas printed in bold italics are preferably used because the measured data will be most accurate. If there are several suitable peaks available, the individual gain factors can be averaged. If p1 and p2 are from the same isotopic pattern, their intensities (Int(p)) can be computed via their isotopic ratios, if e.g. only the total intensity of the respective substance is known. It is possible that the actual gain is not constant (as assumed above).

Instead, it might be dependent on the m/z and the number of ions. So the gain might be best described using a function receiving two parameters: gain(m/z, intensity). This function is different for each channel and can be approximated from peaks found in the calibrant. It must be ensured that the calibrant yields enough high quality peaks for doing this calibration.

After the external calibration, which is carried out before the internal calibration, typically the instrument in the case of a TOF spectrometer will already have an accuracy of about 5 ppm. An internal calibration can move the accuracy to about 1 ppm, more desirably 0.1 ppm. The internal calibration is preferably performed by injecting a peak of known mass and intensity. The m/z of this calibration peak should be chosen so that it doesn't interfere with the analyte. If it happens that two peaks are within the expected mass range (+/−accuracy of the external calibration), the intensity can be used as additional criterion. This intensity should remain within one order of magnitude even if there is an analyte peak nearby. Typically, only one peak is used for internal calibration. If necessary, an internal calibrant could be used with more than one peak. The peaks need to be visible only on one channel (preferably the high gain channel). The intensity of the internal calibrant can be used to calibrate the gains of each channel, as long as the peak used for calibration is of high quality.

The channel offset, i.e. time offset, is influenced by cable lengths and delay introduced in the case of a photon multiplier used on the high gain channel. For the calibration of the channel offset used for aligning the channels, it is necessary to reliably determine the position of a single peak visible on both channels or to use two peaks with a known offset. Because of the different gains used on both channels, the first approach might be difficult (either the high gain channel will saturate, or the low gain channel won't be provided with the number of ions necessary for reliable peak detection), the second approach should be used. An isotopic pattern can be used wherein the number of ions can be adjusted so that the monoisotopic peak can be reliably detected on the low gain channel and the first isotopic peak can be detected without saturation on the high gain channel. Alternatively, calibrating the channel offset can be part of the external calibration, so the calibrant for the external calibration should be selected to fulfil the requirements described here.

The calibration may also be used for self monitoring of the instrument, in particular for electron-multiplier or photomultiplier recalibration, life-time and/or replacement. The aging effect of a photomultiplier and/or the MCPs for example can be adjusted using the external calibration, although even so the photomultiplier in particular needs to be replaced at some point in time (the MCPs operate at relatively low gain, so they should work for the whole life time of the instrument). For this purpose, the external calibration should be performed at regular intervals, or when the device detects irregularities, such as when peaks that should be detected with a specific intensity on each channel aren't detected with that intensity (e.g. a peak that is visible on the low gain channel should be visible on the high gain channel as well with the following intensity: Area(p.ch2) =Area(p.ch1)*g2/g1 or overflow. There may be many points/peaks above threshold in the spectra with both detection signals present. The ratio between the channels in these points can be used to continuously update the actual gain ratio. If the aging of the photomultiplier cannot be regulated by increasing the amplification factor of the photomultiplier alone, it is time to replace the photomultiplier. To allow the user to continue working with the instrument, the amplification of the MCPs can be increased for a limited amount of time (to avoid aging of the MCPs) so that either both or the low gain channel only will supply useable data. The dynamic range of the instrument is reduced under these contingency conditions.

The data acquisition system is also capable of making data dependent decisions. In FIG. 2 is shown data dependent decision modules 130 and 140 preferably implemented on the instrument computer due to algorithmic complexity. These modules enable decisions to be taken based upon assessment of the data in the processed detection signals and/or merged spectrum, especially based on the merged spectrum. Further details of the decisions which may be taken are described now with reference to FIG. 9 which shows a schematic flow chart of decisions which can preferably be made by decision module 140. A peak is assessed by the module 140. In a first step it is decided whether the peak is due to a low number of ions (a threshold for a low number of ions being predetermined) and if the answer is yes the peak may be re-acquired by the spectrometer and if the answer is no the process moves onto the next step 144. In the next step 144 it is decided whether the peak splits into sub-peaks and if the answer is yes the peak may be re-acquired by the spectrometer with a higher resolution and if the answer is no the process moves onto the next step 146 (if the centroider as previously described finds more than one centroid in a given width it is assumed that it is has found overlapping peaks). In the next step 146 it is decided whether a centroid was determined and if the answer is yes the peak may be re-acquired by the spectrometer with more ions and/or more detection signals or spectra may be added together and if the answer is no the process moves onto the next step 148 (if the centroider as previously described fails to detect a centroid this indicates that an insufficient number of ions were acquired). In the next step 148 it is decided whether an overflow flag is associated with the peak in the merged spectrum (which indicates that both channels were saturated/overloaded) and if the answer is yes the peak may be re-acquired by the spectrometer with less ions and if the answer is no then optionally the process may stop making data dependent decisions for that peak or may proceed to one or more further steps of making data dependent decisions.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" (e.g. a photon detector etc.) means "one or more" (e.g. one or more photon detectors etc.).

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A data acquisition system for detecting ions producing secondary electrons in a mass spectrometer, the system comprising:

a detection system for detecting the ions producing the secondary electrons comprising two or more detectors for outputting two or more detection signals in separate channels in response to the ions arriving at the detection system, the detection signals being produced in response to the ions producing the secondary electrons, wherein the secondary electrons that arrive at a first detector to produce a first detection signal from the first detector arrive at a second detector after a time delay to produce a second detection signal from the second detector, the signals being shifted in time relative to each other; and a data processing system for receiving and processing the detection signals in parallel in separate channels of the data processing system and for merging the processed detection signals to construct a mass spectrum;

wherein the processing in parallel in separate channels comprises digitizing the detection signals in separate channels of an analog-to-digital converter (ADC) and removing noise from the digitized detection signals by applying a threshold to the detection signals in separate channels of a data processing device, detecting peaks in the detection signals and characterizing the detected peaks in the separate channels of the data processing device including generating one or more quality factors for the peaks, and determining centroids of the peaks using a centroiding algorithm, wherein the data processing system is configured to modify operating parameters of the mass spectrometer to (i) increase resolution and acquire the peaks at a higher resolution when the centroiding algorithm identifies more than one centroid in a given width, (ii) increase or decrease a number of ions detected and acquire the peaks with a different number of ions when the quality factor of the peak is below a threshold, or any combination thereof.

2. A data acquisition system as claimed in claim 1 wherein the mass spectrometer is a TOF mass spectrometer and the mass spectrum is a high dynamic range mass spectrum.

3. A data acquisition system as claimed in claim 1 comprising a low gain detector and a high gain detector.

4. A data acquisition system as claimed in claim 3 wherein the low gain detector comprises a charged particle detector and the high gain detector comprises a photon detector.

5. A data acquisition system as claimed in claim 1 comprising at least one pre-amplifier for receiving the detection signals from the detectors and pre-amplifying the detection signals in separate channels of the at least one pre-amplifier prior to digitizing the detection signals.

6. A data acquisition system as claimed in claim 1 wherein a separate threshold is applied to each of the detection signals, optionally wherein each threshold is stored in a look-up-table (LUT) and there is a separate LUT for each detection signal.

7. A data acquisition system as claimed claim 1 wherein the threshold is dynamic and varies with time in the detection signal.

8. A data acquisition system as claimed in claim 1 wherein the processing in separate channels comprises packing only points of the detection signals which pass the threshold for noise removal into frames for transfer in the separate channels between different processors.

9. A data acquisition system as claimed in claim 8 wherein a width of each frame is flexible such that each frame has a size in a range from a minimal size to a maximal size, and such that each frame consists of the minimal size, unless a peak is present where the minimal size is reached in a frame in which case the frame is extended above the minimal size until the peak is finished subject to the frame not extending above the maximal size, so that if the peak is present where the maximal size is reached the points of the peak continue in the next frame.

10. A data acquisition system as claimed in claim 8 wherein the data processing system comprises a dedicated processor for performing the processing steps in the separate channels of removing the noise and packing the points of the detection signals which pass the threshold.

11. A data acquisition system as claimed in claim 10 wherein the data processing system comprises an instrument computer which receives the detection signals from the dedicated processor in the separate channels wherein the instrument computer performs at least any further processing of the detection signals in the separate channels and the merging of the processed detection signals.

12. A data acquisition system as claimed in claim 1 wherein the processing comprises using one or more of the quality factors to determine whether the determined centroid of a peak is reliable and whether further action is necessary wherein the further action comprises applying a different peak detection and/or centroiding algorithm, or acquiring the peak again.

13. A data acquisition system as claimed in claim 12 wherein the quality factor of a peak comprises the smoothness and/or shape of the peak and optionally the processing comprises comparing the smoothness and/or shape of the peak to an expected or model smoothness and/or shape.

14. A data acquisition system as claimed in claim 1 wherein the processing comprises aligning the detection signals to correct for time delays between them prior to merging the detection signals.

15. A data acquisition system as claimed in claim 1 wherein one of the detection signals is a high gain detection signal and one of the detection signals is a low gain detection signal, and the merging of the processed detection signals comprises: merging the high gain detection signal and the low gain detection signal to form a high dynamic range mass spectrum which comprises the high gain detection signal where the high gain detection signal is not saturated and the low gain detection signal where the high gain detection signal is saturated, and where the low gain detection signal is scaled by the amplification of the high gain detection signal relative to the low gain detection signal where the low gain detection signal is used in the high dynamic range mass spectrum.

16. A data acquisition system as claimed in claim 1 wherein one of the detection signals is a high gain detection signal and one of the detection signals is a low gain detection signal, and the merging of the processed detection signals comprises merging the high gain detection signal and the low gain detection signal to form a high dynamic range mass spectrum, wherein no user interaction is required for ensuring that the data acquisition system always selects the appropriate detection signal for the merged spectrum with a linear response, and wherein the data acquisition system automatically detects a parallel range where the low gain and the high gain detection signals have a linear response in parallel, and changes to the appropriate detector outside the parallel range which has a linear response.

17. A data acquisition system as claimed in claim 1 wherein the merging of the processed detection signals comprises merging, for a given peak, only the detection signal with the highest quality factor for that peak.

18. A data acquisition system as claimed in claim 1 wherein the processing in the separate channels comprises summing a plurality of the detection signals in each channel before merging the processed detection signals.

19. A data acquisition method for detecting ions in a mass spectrometer, the method comprising:

detecting the ions using a detection system comprising two or more detectors and outputting two or more detection signals from the two or more detectors in separate channels in response to the ions arriving at the detection system, and producing secondary electrons, wherein the secondary electrons that arrive at a first detector to produce a first detection signal from the first detector arrive at a second detector after a time delay to produce a second detection signal from the second detector, wherein the detection signals are shifted in time relative to each other;

receiving and processing the detection signals in parallel in separate channels of a data processing system, wherein the processing in separate channels comprises digitizing the detection signals in separate channels of an analog-to-digital converter (ADC) and removing noise from the digitized detection signals by applying a threshold to the detection signals in separate channels of a data processing device;

detecting peaks in the detection signals and characterizing the detected peaks in separate channels of the data processing device including generating one or more quality factors for the peaks and determining centroids of the peaks using a centroiding algorithm, modifying operating parameters of the mass spectrometer to (i) increase resolution and acquire the peaks at a higher resolution when the centroiding algorithm identifies more than one centroid in a given width, (ii) increase or decrease a number of ions detected and acquire the peaks with a different number of ions when the quality factor of the peak is below a threshold, or any combination thereof; and merging the processed detection signals in the data processing system to construct a mass spectrum.

* * * * *